US008342661B2

(12) United States Patent
Takahashi et al.

(10) Patent No.: US 8,342,661 B2
(45) Date of Patent: Jan. 1, 2013

(54) INK SUPPLYING APPARATUS, INKJET PRINTING APPARATUS, INKJET PRINTING HEAD, INK SUPPLYING METHOD AND INKJET PRINTING METHOD

(75) Inventors: Yuuichi Takahashi, Yoshikawa (JP); Daisuke Nakamura, Nagareyama (JP); Takefumi Tamura, Tokyo (JP); Yuuko Saijo, Noda (JP)

(73) Assignee: Canon Finetech Inc., Joso-Shi (JP)

( * ) Notice: Subject to any disclaimer, the term of this patent is extended or adjusted under 35 U.S.C. 154(b) by 392 days.

(21) Appl. No.: 12/335,223

(22) Filed: Dec. 15, 2008

(65) Prior Publication Data

US 2009/0160915 A1 Jun. 25, 2009

(30) Foreign Application Priority Data

Dec. 19, 2007 (JP) ..... 2007-327996
Dec. 19, 2007 (JP) ..... 2007-327997

(51) Int. Cl.
*B41J 2/175* (2006.01)
*B41J 29/38* (2006.01)
*B41J 2/18* (2006.01)

(52) U.S. Cl. ..... 347/85; 347/5; 347/6; 347/84; 347/89

(58) Field of Classification Search ..... 347/85
See application file for complete search history.

(56) References Cited

U.S. PATENT DOCUMENTS 4,558,326 A * 12/1985 Kimura et al. ..... 347/30
4,571,599 A * 2/1986 Rezanka ..... 347/87
5,489,925 A * 2/1996 Brooks et al. ..... 347/6
5,541,632 A * 7/1996 Khodapanah et al. ..... 347/87
5,801,737 A 9/1998 Sato et al. ..... 347/86
5,910,810 A * 6/1999 Brooks et al. ..... 347/88
6,511,168 B2 1/2003 Higuma ..... 347/86
6,543,877 B1 * 4/2003 Boutet et al. ..... 347/30
6,705,711 B1 * 3/2004 Richards ..... 347/85
7,344,230 B2 * 3/2008 Moynihan ..... 347/85
2003/0122904 A1 7/2003 Matsumoto ..... 347/85
2005/0128231 A1 * 6/2005 Talon et al. ..... 347/7
2006/0061636 A1 * 3/2006 Moynihan ..... 347/84
2006/0132554 A1 * 6/2006 Ota et al. ..... 347/85

FOREIGN PATENT DOCUMENTS

EP 1147903 10/2001
EP 1380429 1/2004
JP 3-281252 12/1991
JP 6-198904 7/1994
JP 2002-001988 1/2002
JP 2003-011380 1/2003
JP 2003-182104 7/2003
JP 2004-098403 4/2004

(Continued)

OTHER PUBLICATIONS

Extended European Search Report dated Mar. 4, 2009, from corresponding European Application No. 08172074.0.

(Continued)

*Primary Examiner* — Laura Martin
*Assistant Examiner* — Jeremy Bishop
(74) *Attorney, Agent, or Firm* — Fitzpatrick, Cella, Harper & Scinto

(57) ABSTRACT

An inkjet printing apparatus which can perform cost-down and an improvement on a print quality by simplification of an apparatus construction is realized. For realizing such an apparatus, a gas-liquid separation is achieved by the construction where air bubbles generated in an ejection portion or a reservoir can rise to a liquid surface, and a negative pressure control and at the same time, discharge of the air bubbles are performed by a fan.

8 Claims, 25 Drawing Sheets

FOREIGN PATENT DOCUMENTS

| | | |
|---|---|---|
| JP | 2005-161834 | 6/2005 |
| JP | 2006-044015 | 2/2006 |
| JP | 2006-075998 | 3/2006 |
| JP | 2006-326855 | 12/2006 |
| JP | 2007-245484 | 9/2007 |

OTHER PUBLICATIONS

English language translation of Japanese Office Action dated Apr. 20, 2012, in counterpart Japanese Application No. 2007-327997.

Japanese Office dated Feb. 9, 2012 in counterpart Japanese Application No. 2007-327996 and English translation thereof.

Japanese Office Action dated Apr. 20, 2012 in counterpart Japanese Application No. 2007-327997, and machine-generated translation thereof.

Japanese Office Action, which is dated Jul. 13, 2012, in counterpart Japanese Patent Application No. 2007-327997, and English translation thereof.

* cited by examiner

INK SUPPLYING APPARATUS, INKJET PRINTING APPARATUS, INKJET PRINTING HEAD, INK SUPPLYING METHOD AND INKJET PRINTING METHOD

BACKGROUND OF THE INVENTION

1. Field of the invention

This invention relates to an inkjet printing apparatus which ejects a liquid toward a print medium to perform print.

2. Description of the Related Art

There is known an inkjet printing apparatus which ejects ink toward a print medium from a printing head to perform print. In such an inkjet printing apparatus, in general a downsized printing head in which a plurality of nozzles ejecting the ink are formed in high concentration is used to perform high-fineness print. Further, a plurality of these downsized printing heads are located to supply ink of different colors to the respective printing heads, thereby making it possible to perform color print onto a print medium with a relatively inexpensive and downsized construction. Therefore, the inkjet printing apparatus is used in various printing apparatuses such as a printer, a facsimile and a copier whether it is for business use or for household use.

In such an inkjet printing apparatus, it is important to maintain ink in the printing head to be in a predetermined negative pressure (maintain a pressure exerting on the ink in the printing head to be in a predetermined negative pressure) for stabilizing an ink ejection operation from the printing head. Therefore, a negative pressure generating device is generally provided in an ink supplying system supplying ink to the printing head and the ink to which the negative pressure is applied by the negative pressure generating device is supplied to the printing head.

Japanese Patent Laid-Open No. 2002-1988 discloses, as the negative pressure generating device, the construction of generating a negative pressure by using a capillary function of a sponge-shaped ink absorber accommodated in an ink tank. Further, Japanese Patent Laid-Open No. 06-198904 discloses, as another negative pressure generating device, the construction provided with a flexible ink bag and an arched spring. In addition, Japanese Patent Laid-Open No. 2003-11380 discloses, as the other negative pressure generating device, the construction where an ink tank is located at a position lower than a printing head and a negative pressure is applied to ink by using a water head difference between the printing head and the ink tank.

In the ink supplying system equipped with the negative pressure generating device as disclosed respectively in Japanese Patent Laid-Open No. 2002-1988 to Japanese Patent Laid-Open No. 2003-11380, the negative pressure in the printing head increases with the ink ejection from the printing head. The ink is supplied from the ink tank to the printing head by taking advantage of this increasing negative pressure. Therefore, when a great amount of the ink is ejected per unit time from the printing head, the ink supply from the ink tank to the printing head does not possibly match the ink ejection amount. Therefore, the negative pressure in the printing head may be larger than a predetermined negative pressure. In reverse, when a small amount of the ink is ejected per unit time from the printing head, the negative pressure in the printing head may be smaller than the predetermined negative pressure due to inertia of the ink.

For solving such an issue, Japanese Patent Laid-Open No. 2006-326855 discloses the construction where ink supply to a printing head is carried out by a pump and a negative pressure in the printing head is controlled by a fan, thus carrying out the supply of the ink and the control of the negative pressure separately.

However, in a case of directly controlling the negative pressure in the printing head by the fan, it is required for the negative pressure control to respond quickly to a pressure fluctuation in the printing head. That is, since the negative pressure generated by the fan acts directly on an inside of a nozzle, it is required that the negative pressure control responds to a pressure in the printing head changing with an ejection state of the ink to immediately carry out the follow-up to the pressure fluctuation. Conventionally, the rotational speed of the fan is kept constant and in such a state, the follow-up is carried out by moving air in response to a pressure difference change between a suction port and a discharge port of the fan or in a case where the pressure change is large for a short period of time, it is required to control the rotational speed of the fan.

Conventionally, a range in which the pressure fluctuation in the printing head can be absorbed in a state of maintaining the rotational speed of the fan to be constant, is limited. In a case of controlling the rotational speed of the fan, it is required to control the fan in high responsiveness for maintaining the negative pressure in the printing head to be constant and further, it is required to control the rotational speed of the fan even in consideration of responsiveness of the pressure change in the printing head at the time of changing the rotational speed of the fan. In consequence, it is unavoidable for the control of the fan to be complicated.

In addition, in a case of controlling the negative pressure in the printing head by the fan, the ink in the printing head is directly stirred by the fan. Therefore, evaporation of water components contained in the ink is promoted, thereby possibly increasing viscosity of the ink. In a case where the ink exchange becomes necessary due to degradation by the increased viscosity of the ink, new ink is required, possibly increasing the running cost.

SUMMARY OF THE INVENTION

Therefore, it is an object of the present invention to provide an ink supplying apparatus, an inkjet printing apparatus, an ink supplying method and an inkjet printing method each of which can simplify negative pressure control of ink supplied to an ejection portion of the ink, thereby achieving cost-down by simplification of an apparatus construction.

According to a first aspect of the present invention, an inkjet printing apparatus including a printing head having an ejection portion capable of ejecting ink and an ink supplying apparatus supplying the ink to the printing head comprises:

a liquid chamber for reserving the ink supplied to the printing head; an air releasing portion for releasing air in a space provided at an upper side of the liquid chamber to an outside; and an air introducing portion capable of introducing air of the outside into the space, wherein the printing apparatus further comprises a control portion for controlling a pressure in the space to be constant by adjusting an air releasing amount from the air releasing portion and an air introducing amount from the air introducing portion.

According to a second aspect of the present invention, an ink supplying method of supplying ink to a printing head having an ejection portion capable of ejecting the ink comprises: releasing air in an upper side of a liquid chamber provided in the printing head via an air passage to an outside; introducing air of the outside into the air passage; and thereby generating a negative pressure in the liquid chamber.

According to a third aspect of the present invention, an inkjet printing method of performing print on a print medium by ejecting ink supplied from a liquid chamber from an ejection portion comprises: upon performing the print on the print medium, releasing air in an upper side of the liquid chamber via an air passage to an outside; introducing air of the outside into the air passage; and thereby generating a negative pressure in the liquid chamber.

According to a fourth aspect of the present invention, an inkjet printing head comprises: an ejection portion capable of ejecting ink; a liquid chamber for reserving the ink supplied to the ejection portion, wherein the liquid chamber is provided with an ink reservoir communicated with the ejection portion and capable of reserving the ink, an ink introducing portion capable of introducing the ink into the ink reservoir, an air chamber located at an upper side of the ink reservoir, an air introducing portion capable of introducing air into the air chamber, and an air releasing portion for releasing the air in the air chamber to an outside; and a pressure holding device for holding to apply a negative pressure into the liquid chamber in a state where the ink introducing portion, the air introducing portion and the air releasing portion are shut off from the liquid chamber.

According to the present invention, a negative pressure is generated in the liquid chamber by releasing air at an upper side of the liquid chamber through the air passage to an outside and at the same time, introducing air of the outside into the air passage. In consequence, the negative pressure control in the printing head can be performed by a simple control, thereby achieving the cost-down due to simplification of an apparatus construction.

Further features of the present invention will become apparent from the following description of exemplary embodiments (with reference to the attached drawings).

DESCRIPTION OF THE EMBODIMENTS (First Embodiment)

A first embodiment in the present invention will be described below with reference to the accompanying drawings.

Figure 1:
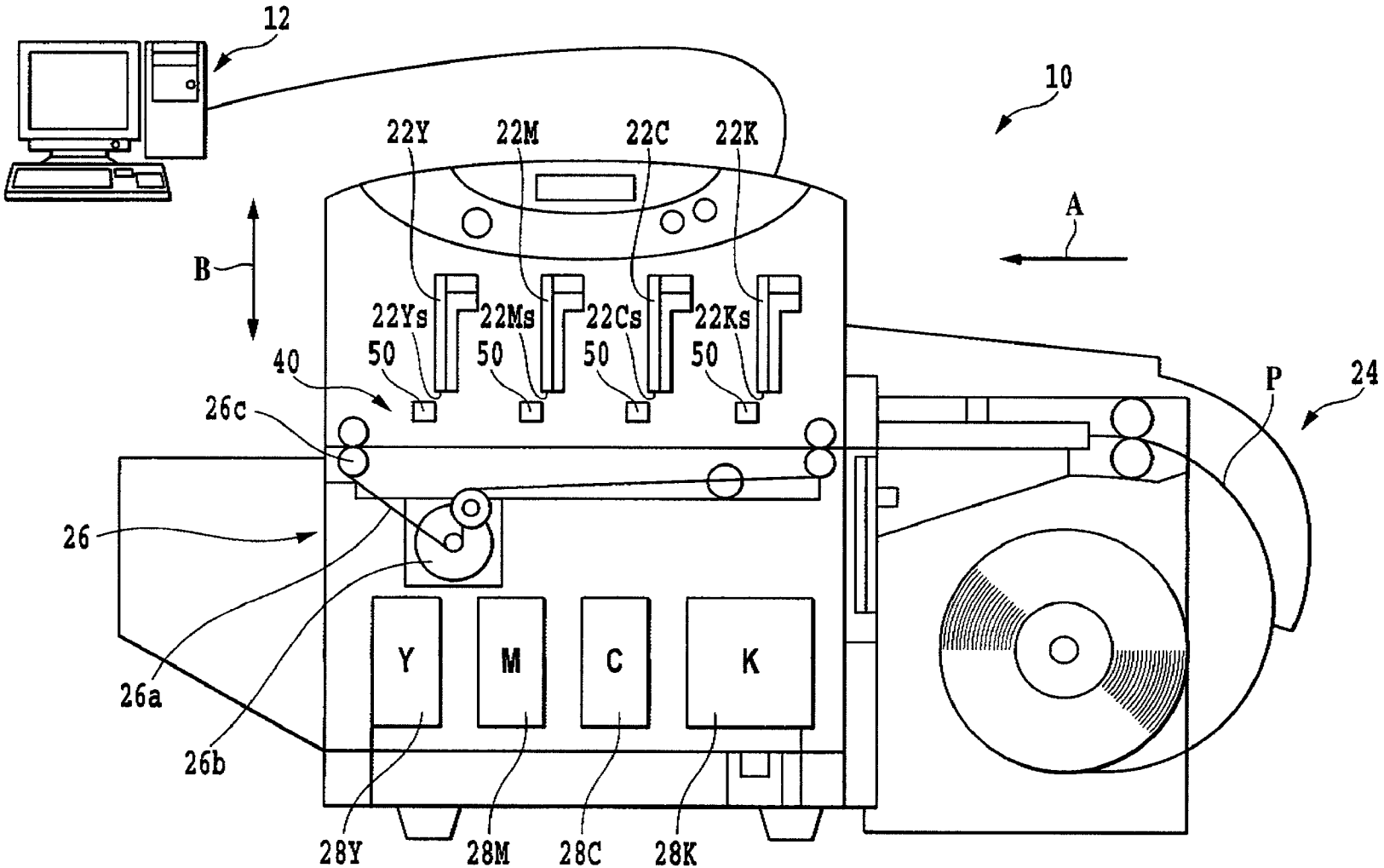
FIG. 1 is a front view schematically illustrating an inkjet printing apparatus to which a first embodiment of the present invention is applicable.

FIG. 1 is a front view schematically illustrating an inkjet printing apparatus (hereinafter, simply referred to as printing apparatus) to which the present embodiment can be applied. The printing apparatus 10 is connected to a host PC 12 and ink is ejected from four head units 22K, 22C, 22M and 22Y onto a print medium (hereinafter, also referred to as roll paper) P based upon print information transmitted from the host PC 12 to perform print. The four head units 22K, 22C, 22M and 22Y are located along a carrying direction (direction of an arrow A) of the print medium P. The respective head units are located in the order of the head unit 22K for black color, the head unit 22C for cyan color, the head unit 22M for magenta color and the head unit 22Y for yellow color in the carrying direction. The head units 22K, 22C, 22M and 22Y are so-called line heads and are arranged in parallel to each other over an entire print width region in the carrying direction of the print medium. When the printing apparatus performs print, a heater provided in the head unit is driven without moving the respective head units to eject ink from the nozzle for performing the print.

When foreign matters such as dusts or ink drippings are attached to faces having nozzles (hereinafter, referred to as ink ejection opening faces) 22Ks, 22Cs, 22Ms and 22Ys in the head units along with the printing, the ejection state of each head unit may change to adversely affect the printing. Therefore, a recovery unit 40 is incorporated in the printing apparatus 10 so that the ink can be stably ejected from the respective head units 22K, 22C, 22M and 22Y. By periodically cleaning the ink ejection opening face with the recovery unit 40, each ink ejection state from the nozzles of the head units 22K, 22C, 22M and 22Y can be recovered to the initial, good ink ejection state. Caps 50 are provided in the recovery unit 40 for removing ink from the ink ejection opening faces 22Ks, 22Cs, 22Ms and 22Ys of the four head units 22K, 22C, 22M and 22Y. The cap 50 is provided independently from each head unit 22K, 22C, 22M and 22Y and is constructed of a blade, an ink removal member, a blade holding member, a cap and the like.

The print medium P is supplied from a roll paper feeding unit 24 and is carried in a direction of an arrow A by a carrying mechanism 26*a* incorporated in the printing apparatus 10. The carrying mechanism 26 is constructed of a carrying belt 26*a* for carrying the roll paper P thereon, a carrying motor 26*b* for rotating the carrying belt 26*a*, a roller 26*c* for applying a tension force to the carrying belt 26*a*, and the like.

In the event of performing the print, when the roll paper P in the middle of the carrying comes under the head unit 22K in black, black ink is ejected from the head unit 22K based upon print information sent from the host PC 12. Likewise, ink in respective colors is ejected in the order of the head units 22C, 22M and 22Y to complete color printing onto the roll paper P.

Further, the printing apparatus 10 is provided with main tanks 28K, 28C, 28M and 28Y for reserving ink, a pump which can supplement ink to each unit, a pump for performing a cleaning operation to be described later (refer to FIG. 3 or the like), and the like.

Figure 2:
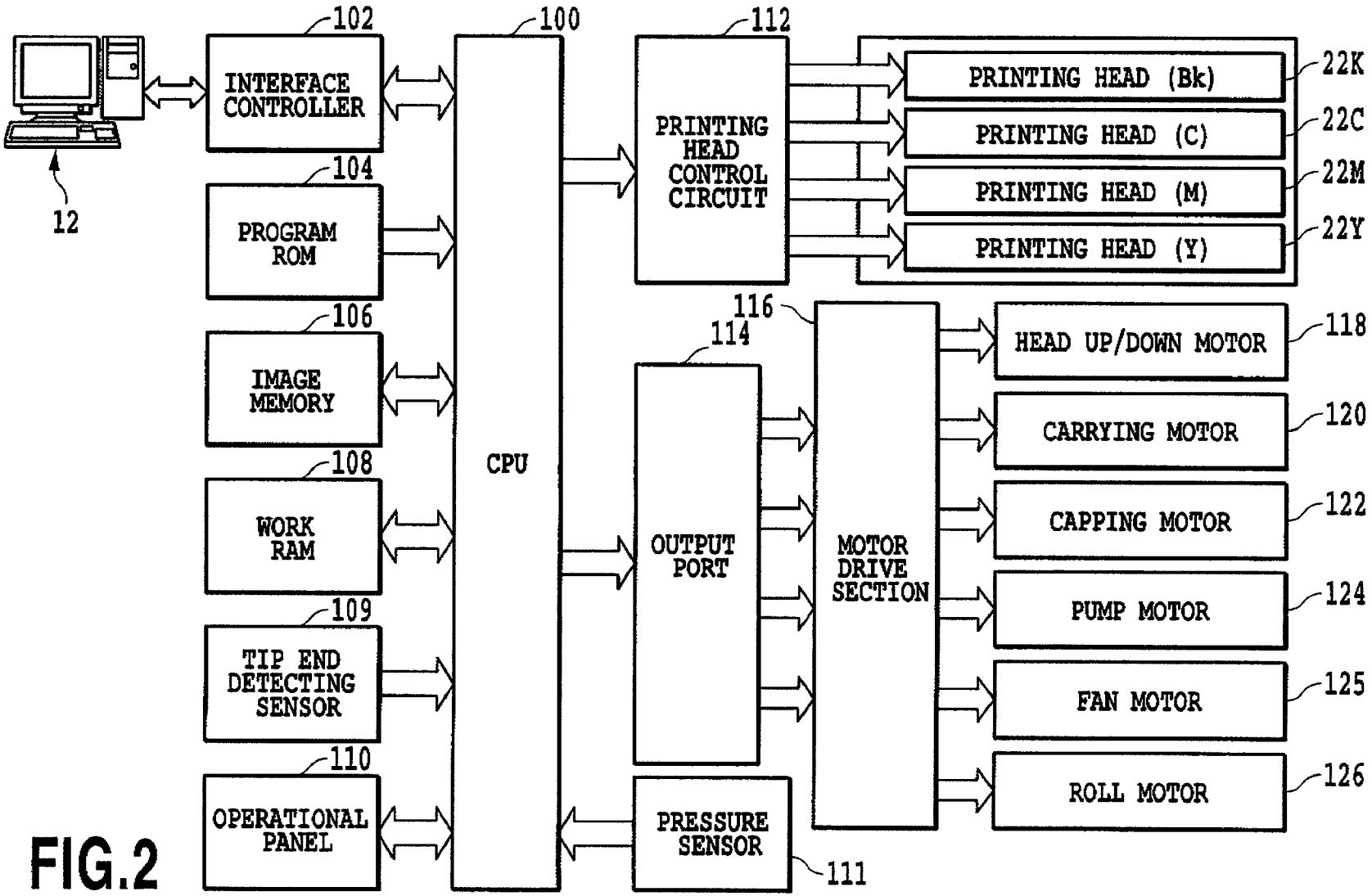
FIG. 2 is a block diagram illustrating a control system of the inkjet printing apparatus in FIG. 1.

FIG. 2 is a block diagram illustrating a control system of the printing apparatus 10 in FIG. 1. Print information or a command sent from the host PC (host device) 12 is received through an interface controller 102 by a CPU 100. The CPU 100 is a calculation processing unit for performing an entire control of reception of the print information and a printing operation in the printing apparatus, handling of the roll paper P, and the like. The CPU 100, after analyzing the received command, carries out bit map development of image data of respective color components in print data to an image memory 106 for the drawing. In an operation processing before printing, a capping motor 122 and a head up-down motor 118 are driven through an output port 114 and a motor drive section 116 to move the respective head units 22K, 22C, 22M and 22Y to respective printing positions away from caps 50. In addition, the CPU 100, as described later, performs control for correcting as needed rotation of a fan motor of a fan for applying an appropriate negative pressure to the head units 22K, 22C, 22M and 22Y, based upon pressure information obtained by a pressure sensor.

Further, the CPU 100 performs control of carrying the roll paper P to the printing position by driving a roll motor 126 for feeding out the roll paper P through the output port 114 and the motor drive section 116, a carrying motor 120 for carrying the roll paper P, and the like.

For determining a timing (print timing) for ejecting ink to the roll paper P carried at a constant speed at the time of performing the print, a tip end detecting sensor 109 detects a tip end position of the roll paper P. Thereafter, the CPU 100 sequentially reads out the print information from the image memory 106 in synchronization with the carrying of the roll paper P and transfers the read image information via a head unit control circuit 112 to the respective head units 22K, 22C, 22M, and 22Y.

An operation of the CPU 100 is performed based upon a processing program stored in a program ROM 104. A processing program corresponding to a control flow, a table and the like are stored in the program ROM 104. In addition, the CPU 100 uses a work RAM 108 as a memory for an operation. Further, the CPU 100 drives the pump motor 124 through the output port 114 and the motor drive section 116 upon cleaning or recovering the respective head units 22K, 22C, 22M and 22Y to perform control of pressurization and suction of ink or the like.

Figure 3:
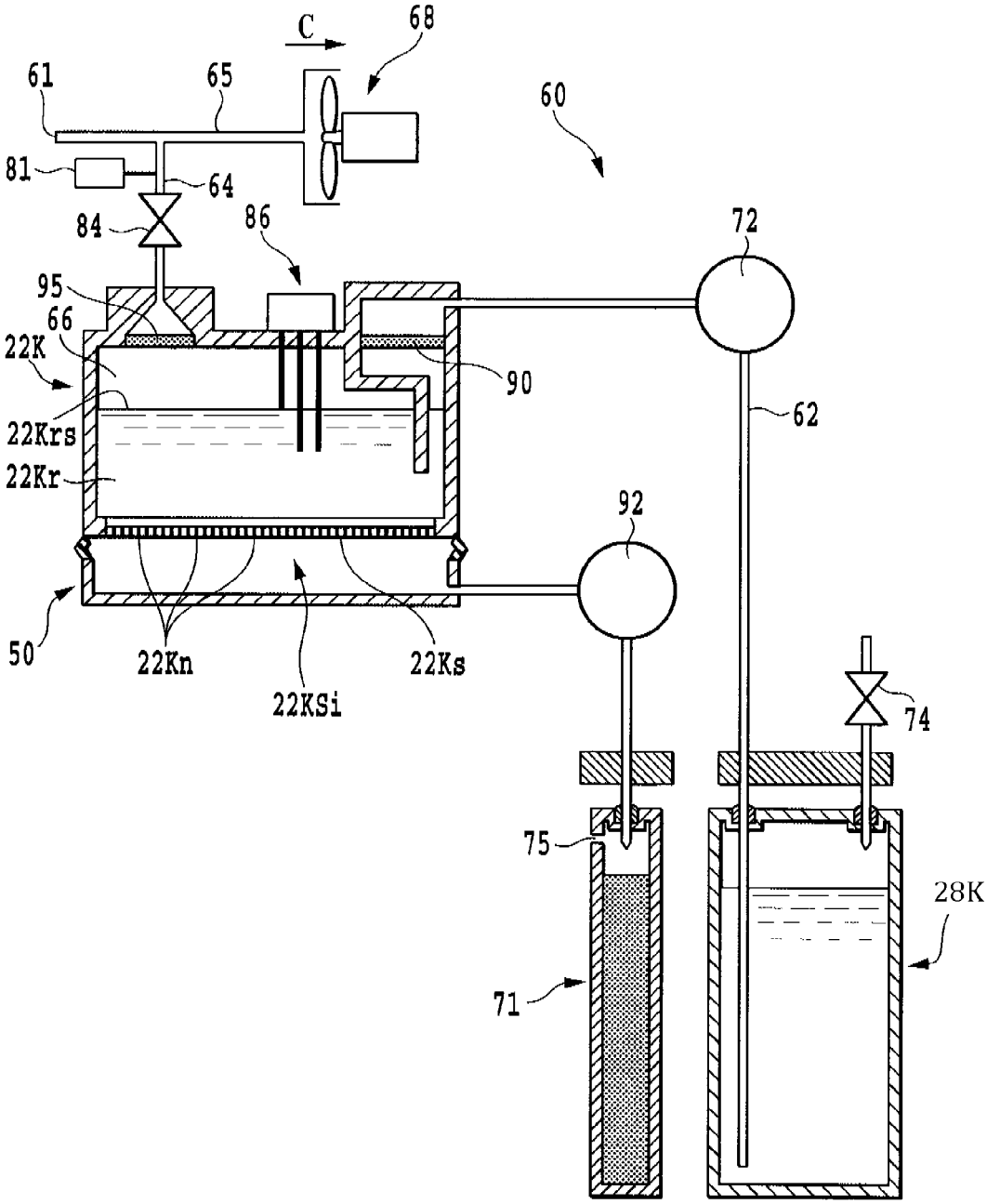
FIG. 3 is a diagram schematically illustrating an ink route from an ink tank to a head unit of the printing apparatus according to the first embodiment.

FIG. 3 is a schematic diagram illustrating a route of ink from the ink tank 22K to the head unit 22K. Since the respective head units are of the same construction, hereinafter the head unit 22K for black ink only will be explained as an example.

An ink supplying apparatus 60 is incorporated in the printing apparatus 10 for supplying ink to the head unit 22K. The head unit 22K is provided with a reservoir 22Kr and an ejection portion 22KSi capable of ejecting the ink. The ink supplying apparatus 60 is constructed of the ink tank 28K detachable to a main body of the printing apparatus 10, an ink supply pump 72 located in the midway of an ink supply passage 62 connecting the ink tank 28K to the head unit 22K, and the like. The supply pump 72 performs ink supply to the reservoir 22Kr through an ink filter 90.

A liquid surface detecting sensor 86 is attached to the reservoir 22Kr for detecting a level of a liquid surface 22Krs of ink reserved in the reservoir 22Kr (hereinafter, also referred to as reserve ink). A nozzle 22Kn of the head unit 22K and an ejection portion 22KSi in which and an ink supply port to the nozzle 22Kn is formed are connected below the reservoir 22Kr.

An air passage 64 is connected via an air filter 95 to a space 66 (hereinafter, referred to as air chamber) filled with air at an upper side of the reservoir 22Kr, and the air passage 64 is provided with an air valve 84 and a pressure detecting sensor 81 capable of detecting a pressure. The pressure detecting sensor 81 can detect a pressure in the air chamber 66. In addition, one end of the air passage 64 is provided with the air filter 95 and the other end opposite to the one end is connected to a pressure-reducing passage 65 to form a T-shape. The pressure-reducing passage 65 has one end open to an air and the other end connected to a fan 68.

A detecting sensor (not shown) is attached to the ink tank 28K for detecting presence/absence of ink in the ink tank 28K. An air releasing valve 74 is attached to the ink tank 28K for making an inner pressure in the ink tank 28K equal to an atmospheric pressure.

When it is determined that the ink liquid surface 22Krs is less than a given level based upon the detection result of the liquid surface detecting sensor 86 of the reservoir 22Kr, the air releasing valve 74 of the ink tank 28K is released and the supply pump 72 is driven to suck ink from the ink tank 28K. In addition, the sucked ink is supplied into the reservoir 22Kr. On the other hand, when the liquid surface detecting sensor 86 detects the ink liquid surface 22Krs more than the given level, the supply pump 72 stops and the air release valve 74 of the ink tank 28K is closed to stop the supply of the ink.

Incidentally, a tube pump is used as the supply pump 72 and the ink supply passage 62 is blocked at the time the supply pump 72 does not operate (a passage between the ink tank 28K and the reservoir 22Kr is blocked).

Figure 4:
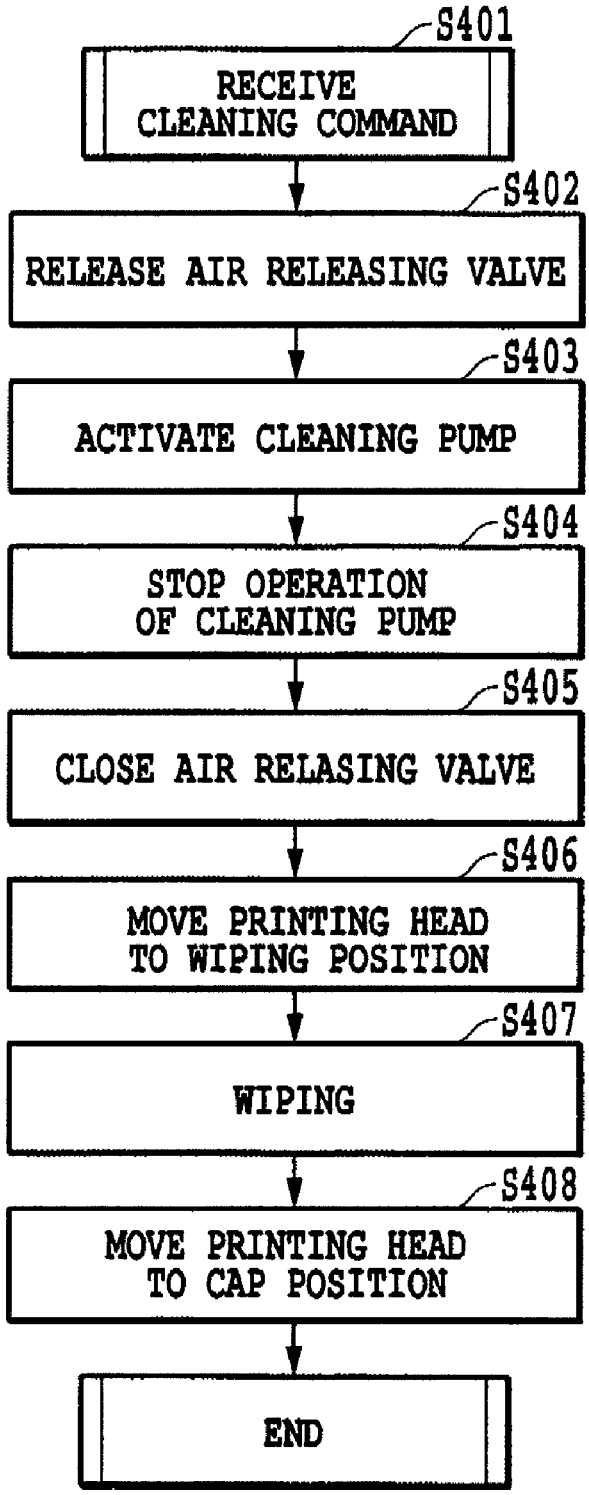
FIG. 4 is a flowchart illustrating the process order at the time of cleaning an ejection opening face of the head unit.
Figure 5A:
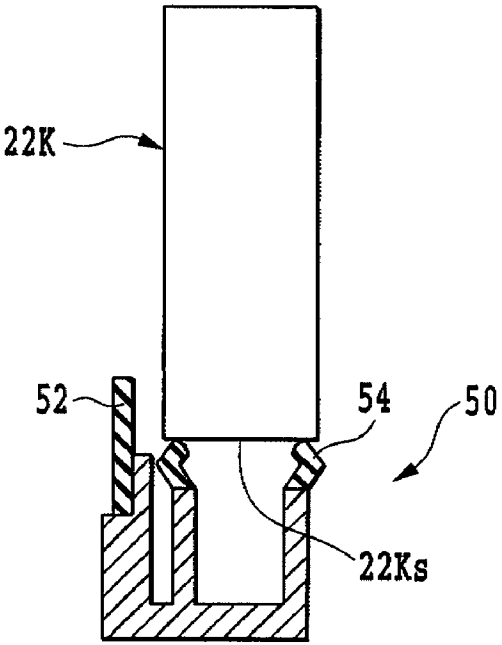
FIG. 5A is a schematic diagram illustrating the process order for wiping off ink from an ejection face by a wiper.
Figure 5B:
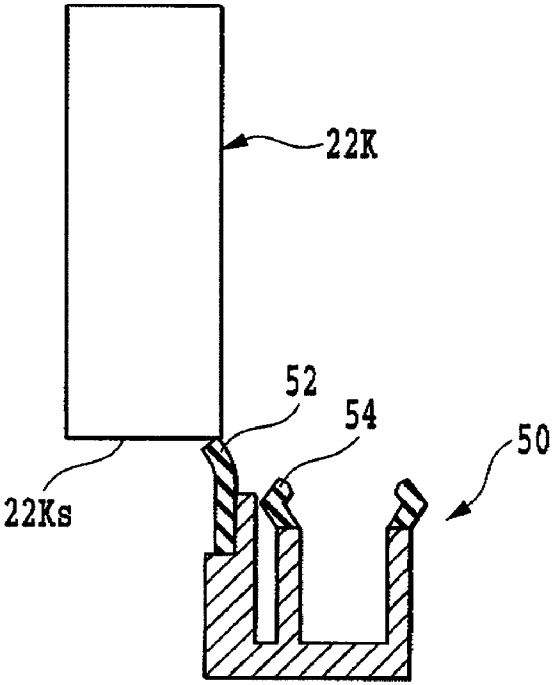
FIG. 5B is a schematic diagram illustrating the process order for wiping off ink from the ejection face by the wiper.
Figure 5C:
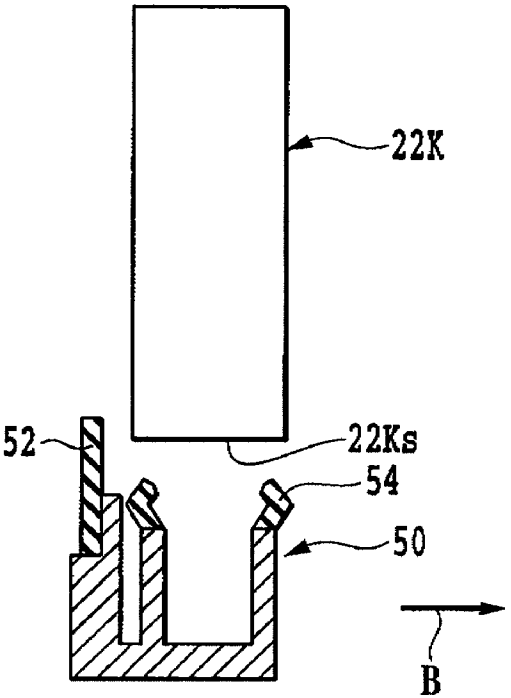
FIG. 5C is a schematic diagram illustrating the process order for wiping off ink from the ejection face by the wiper.

FIG. 4 is a flow chart illustrating the process order for cleaning the ejection opening face 22Ks of the head unit. FIGS. 5A to 5C are schematic diagrams each illustrating the process order for wiping off ink from the ejection face 22Ks by the wiper 52. The cleaning herein means an operation for continuously maintaining the ink ejection of the head unit 22K to be in an appropriate state, and an operation which is automatically or arbitrarily made in a case where the condition such as an elapse time or an ejection state is met, in a case where an abnormality is detected in a print quality or the like. Hereinafter, the operation of the cleaning will be explained in order.

When a cleaning command is received at step S401, the air releasing valve 74 is released at step S402. Thereafter, at step S403, the cleaning pump 92 is driven in such a direction as to reduce a pressure in the cap 50 and sucks the ink in the reservoir 22Kr from the nozzle 22Kn into the cap 50 and discharges the sucked ink. This discharge allows fine bubbles reserved in the surroundings of the nozzle 22Kn during a print operation or foreign matters such as dusts attached on the ejection opening face 22Ks of the head unit to be removed. In addition, after a given time elapse, at step S404 the drive of the cleaning pump 92 is stopped and at step S405 the air valve 74 is closed.

It should be noted that in this state, the ink may be still attached on the ejection opening face 22Ks including an opening of each nozzle 22Kn of the head unit 22K. Therefore, for removing this contamination, as described later, the ejection opening face 22Ks is wiped off by the wiper 52 provided together with the cap 50. On this occasion, first, as shown in FIG. 5A, at step S406 the head unit 22K moves above the recovery cap 50. Thereafter, when at step S407, the cap 50 again moves in a direction of an arrow B, the contamination such as the ink attached on the face 22Ks is, as shown in FIG. 5B, wiped off by the wiper 52. This operation is called a wiping operation and after the wiping operation completion, at step S408 the head unit 22K is again capped as shown in FIG. 5C, to become in a standby state.

In the head unit 22K at the standby state, the face 22Ks is capped (closed) by a cap contact portion 54 and therefore, there is almost no swirl flow of air in the cap 50, thereby preventing the ink in the nozzle 22Kn from increasing the viscosity thereof. When the head unit 22K becomes in the standby state, the cleaning operation ends.

It should be noted that the ink discharged from the nozzle 22Kn (waste ink) is received in the cap 50 and sucked by a suction pump 92 (refer to FIG. 3). The sucked waste ink is fed under pressure to a waste ink tank 71 (refer to FIG. 3). The waste ink tank 71 is provided with a fine small air opening 75, which serves to release a pressure in the waste ink tank 71 changing with inflow of the waste ink (and air bubbles) to an atmosphere.

Figure 6:
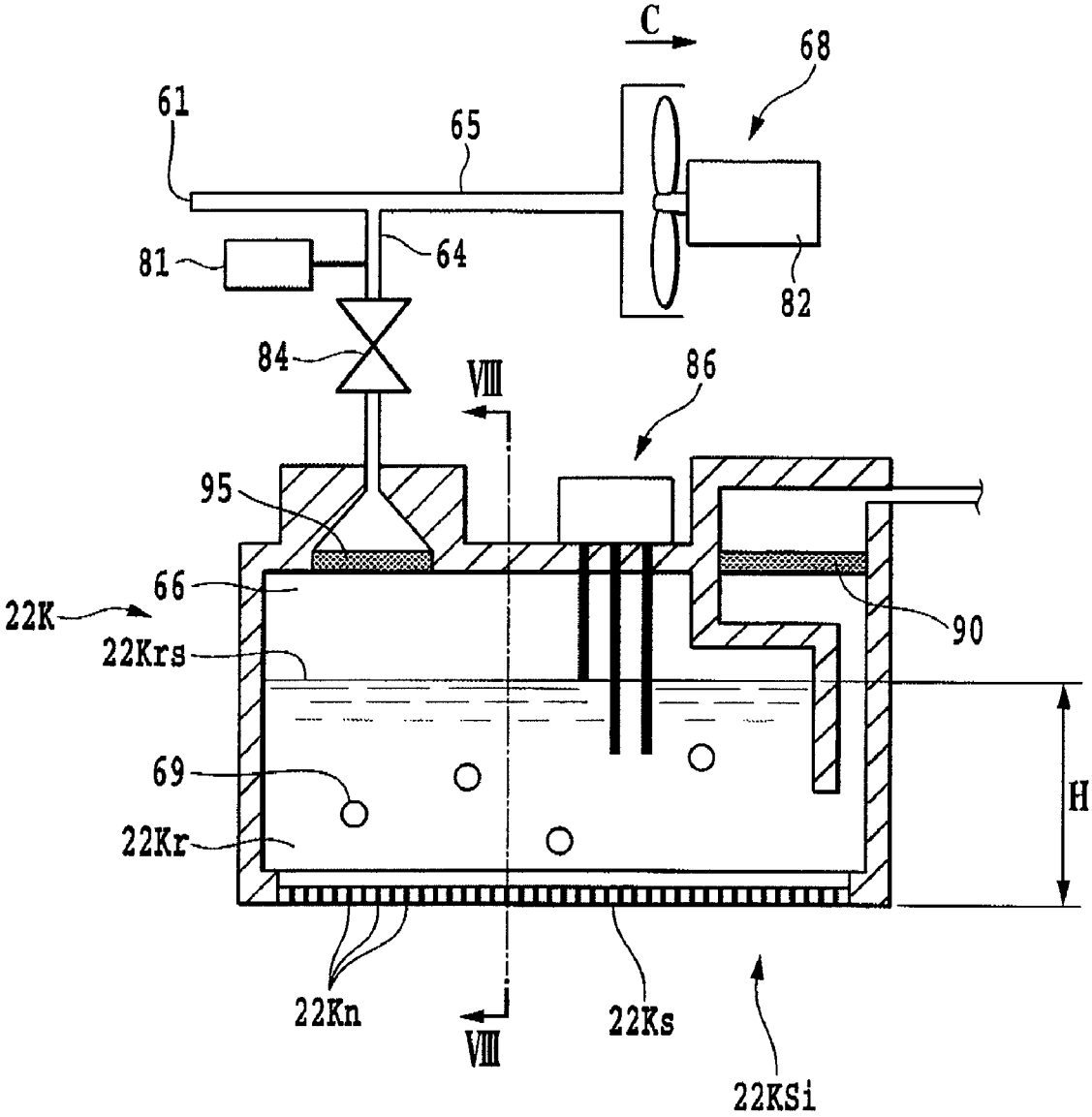
FIG. 6 is an enlarged diagram illustrating the head unit and the surroundings thereof.

FIG. 6 is an enlarged diagram illustrating the head unit 22K and the surroundings thereof. For forming meniscus in the nozzle 22Kn at the time of the printing, it is required to apply an appropriate negative pressure to the head unit 22K. Therefore, the air valve 84 is forced to be in an open state at the time of the printing to operate the fan 68 in such a manner as to form flow of the air in a C direction. Thereby, the air chamber 66 in the head unit 22K is reduced in pressure. In consequence, the pressure in the nozzle 22Kn is likewise reduced through the reservoir 22Kr.

In the present embodiment, since the reservoir 22Kr communicated with an atmosphere is located above the ejection portion 22Ks, the air valve 84 is opened, so that a positive pressure of a water head pressure H from the liquid surface 22Krs exerts on an opening of the nozzle 22Kn. Therefore, a pressure reducing amount into the air chamber 66 by the fan 68 is set more than the water head pressure H. In consequence, a negative pressure is applied to the nozzle 22Kn of the head unit 22K. Therefore, the meniscus of the ink is formed in the opening of the nozzle 22Kn.

The present embodiment does not directly suck the gas by the fan 68 from the space generating the negative pressure as disclosed in Japanese Patent Laid-Open No. 2006-326855, but adopts the method of indirectly sucking the gas as shown in FIG. 6. That is, the negative pressure generated by operating the fan 66 is not applied directly to the air chamber 66, and the negative pressure is applied indirectly to the air chamber 66 by providing the suction port 61 (air introducing portion) capable of introducing air. In addition, in the present embodiment, the flow of the air taken in from the suction port 61 is generated in the pressure reducing passage 65 by operating the fan 68, and the air in the air passage 64 connected to the pressure reducing passage 65 is sucked into the flow of the air in the pressure reducing passage 65 primarily according to an ejector theory. In consequence, a negative pressure is generated in the air chamber 66.

When the air valve 84 is opened, it is required to apply a constant negative pressure to the air chamber 66 for always maintaining the meniscus of the ink in the nozzle to be in an optimal state. When the ink is ejected from the ejection portion 22KSi, an ink amount in the reservoir 22Kr reduces, thereby increasing a negative pressure in the air chamber 66. If the negative pressure in the air chamber 66 is kept high, the meniscus can not be formed in a predetermined position, resulting in not ejecting the ink appropriately. Therefore, for returning the negative pressure which has increased due to ejection of the ink back to a constant negative pressure, it is required to perform pressure adjustment in the air chamber 66.

According to the method of indirectly sucking the air in the space of the air chamber 66 as in the case of the present embodiment, since a part between the air chamber 66 and the fan 68 is communicated with the atmosphere, flow of the air is all the time generated by rotation of the fan 68. The negative pressure in the air chamber 66 is, due to the flow of the air in the pressure reducing passage 65, becomes larger as a rotational speed of the fan 68 increases to increase a flow amount (flow speed) of the air per unit area. In reverse, as the rotational speed of the fan 68 reduces to reduce the flow amount of the air, the negative pressure in the air chamber 66 becomes the smaller.

For maintaining the negative pressure in the air chamber 66 to be constant, it is required that the fan 68 is controlled in accordance with fluctuations of the negative pressure in the air chamber 66 to adjust a flow amount of the air in the pressure reducing passage 65. In the event of adjusting the flow amount in this way, the air flowing steadily acts advantageously. That is, when the pressure in the air chamber 66 changes, an air flow amount in the pressure reducing passage 65 automatically changes in such a manner as to absorb the pressure fluctuation in the air chamber 66 to some degrees even if the rotational speed of the fan 68 is constant. Accordingly, it is not necessary to control the fan 68 so much finely in response to the fine pressure fluctuation in the air chamber 66. That is, a range of being capable of responding to the pressure fluctuation under a constant rotational speed of the fan 68 in the air chamber 66 (degree of being capable of absorbing the pressure head) becomes wider than in the construction as in the case of Japanese Patent Laid-Open No. 2006-326855, that is, in a case of directly absorbing the air in the air chamber.

Therefore, it is possible to stably maintain the pressure in the air chamber 66 to be in a predetermined negative pressure force by a relatively simple control. Even in a case where a pressure fluctuation amount becomes large for a short time, it is possible to maintain a constant negative pressure by controlling rotation of the fan 68 without mentioning. Further, as in the case of the present embodiment, in the method of indirectly sucking the air in the air chamber 66, taking in the air from the atmosphere automatically causes the time until the pressure in the air chamber 66 converges to a target value to be short.

Further, by indirectly sucking the air in the air chamber 66 as in the case of the present embodiment, it prevents the air in the air chamber 66 in contact with the ink in the reservoir 22Kr from being largely stirred. Therefore, volatile components of the ink are difficult to evaporate and the ink is difficult to increase in viscosity. Since a "d" flow is always generated at the time of operating the fan 68 in the present embodiment, it is possible to cool a fan motor 82 by using the flow.

In a case of directly sucking the air in the air chamber by the fan as in the case of the construction in Japanese Patent Laid-Open No. 2006-326855, it is required to control the fan so as to quickly respond to the pressure fluctuation in the air chamber. That is, since the negative pressure generated by the fan exerts directly on the inside of the nozzle, it is required to finely control the rotational speed of the fan. In a case of the pressure control by the fan, however, overshoot or undershoot tends to easily occur to relatively need time for converging the pressure into a target value. Further, since the air in the air chamber is stirred by the fan, evaporation of the volatile components of the ink in the reservoir is possibly promoted.

Figure 7:
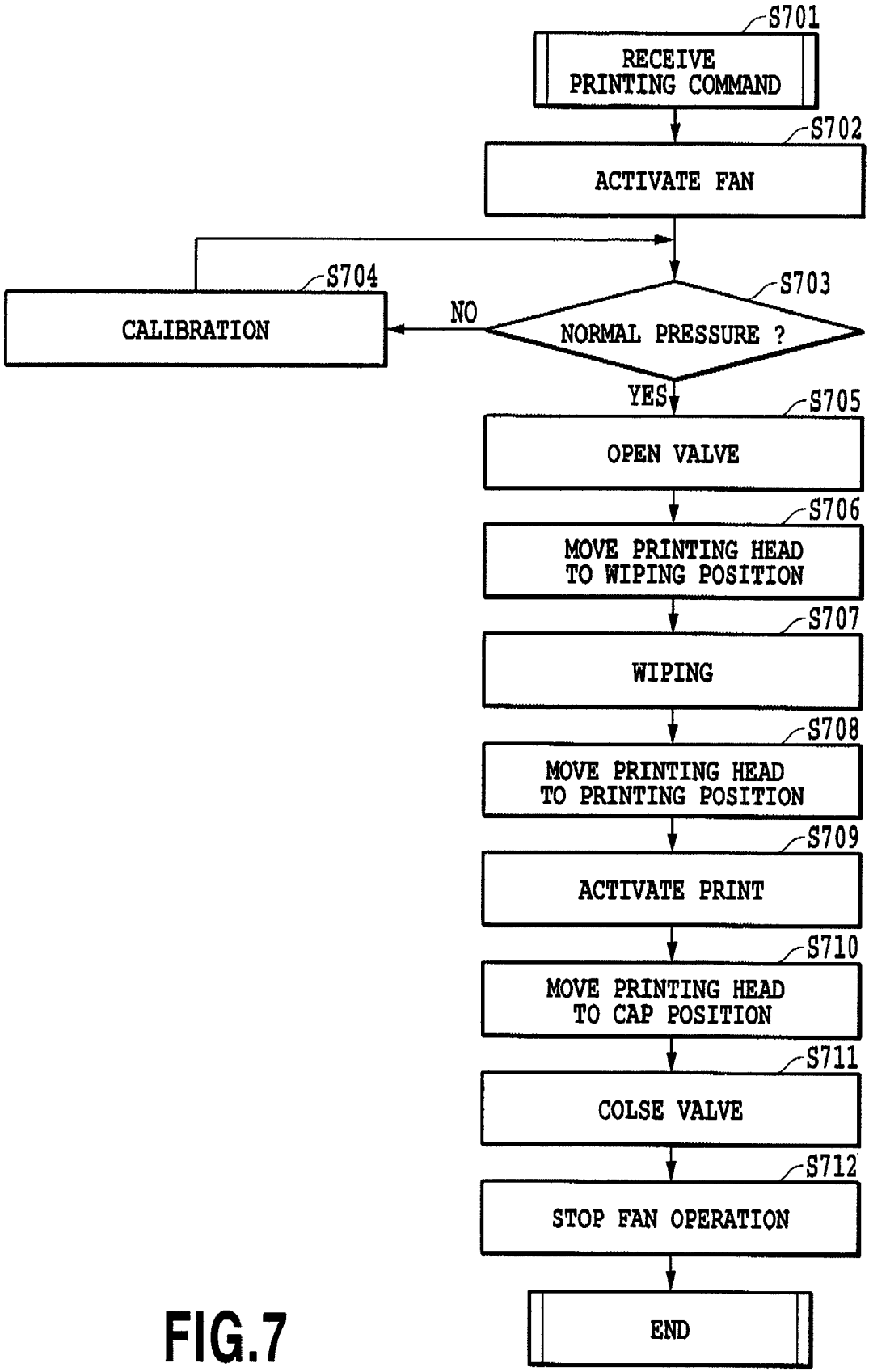
FIG. 7 is a flow chart showing an operation from a point of receiving a print signal to a point of completing print.

FIG. 7 is a flow chart illustrating an operation from reception of a print signal until completion of print. In a state where the printing apparatus is not used, the air valve 84 is usually closed for preventing leak of the ink from the nozzle Kn. In a case of starting the print, first in a state where the air valve 84 is closed, the fan 68 is activated to reduce the pressure in the pressure reducing passage 65 and the air passage 64, and then the air valve 84 is opened. Hereinafter, the processing at the time of performing such print will be explained in order.

When the printing apparatus 10 receives a print signal at step S701, the process goes to step S702, wherein the fan 68 is activated. Next, for confirming whether or not the pressure reduction by the fan 68 is normally performed, a pressure in the air chamber 64 is confirmed by a pressure detecting sensor 81 at step S703. Here, in a case where a predetermined pressure is not obtained, the process goes to step S704, wherein a rotational speed of the fan 68 is corrected. When the predetermined pressure is obtained at step S703, the process goes to step S705, wherein the air valve 84 is opened. Opening the air valve 84 causes reduction in pressure of the air chamber 66, thereby applying the negative pressure to the nozzle 22Kn. Therefore, the meniscus is formed in an opening (ejection opening) of the nozzle Kn in an optimal state.

Next, at step S706 the head unit 22K is moved to a wiping position and at step S707 the wiping of the ejection opening face 22Ks of the head unit 22K is performed. Thereafter, for performing the print at step S708, the head unit 22K is lowered to move to a printing position. At step S709, the print is performed onto a print medium P. After completing the printing operation, at step S710 the head unit 22K is elevated and moves to a standby position where it is again capped by the cap 50. Thereafter, at step S711 the air valve 84 is closed and at step S712 the operation of the fan 68 is stopped and the head unit 22K is again back to the standby mode to end this flow chart.

While the printing operation is performed, the ink in the reservoir 22Kr is being reducing by ink consumption in the printing, but in the construction of the head unit 22K of the present embodiment, the air equal in volume to the reduced ink is introduced via the suction port 61 and the air passage 64 into the air chamber 66. Further, in a case where it is detected that the liquid surface 22Krs is less than a given level by a liquid surface detecting sensor 86, the ink is supplied into the reservoir 22Kr by the ink supply pump 72 until the liquid surface detecting sensor 86 detects an upper limit level of the ink liquid surface 22Krs. On this occasion, the air corresponding to the volume of the ink flowing into the reservoir 22Kr is released via the air passage 64 into an atmosphere. In consequence, the pressure fluctuation exerting on the nozzle 22Kn by an increase/decrease of the ink in the reservoir 22Kr is restricted.

Figure 8:
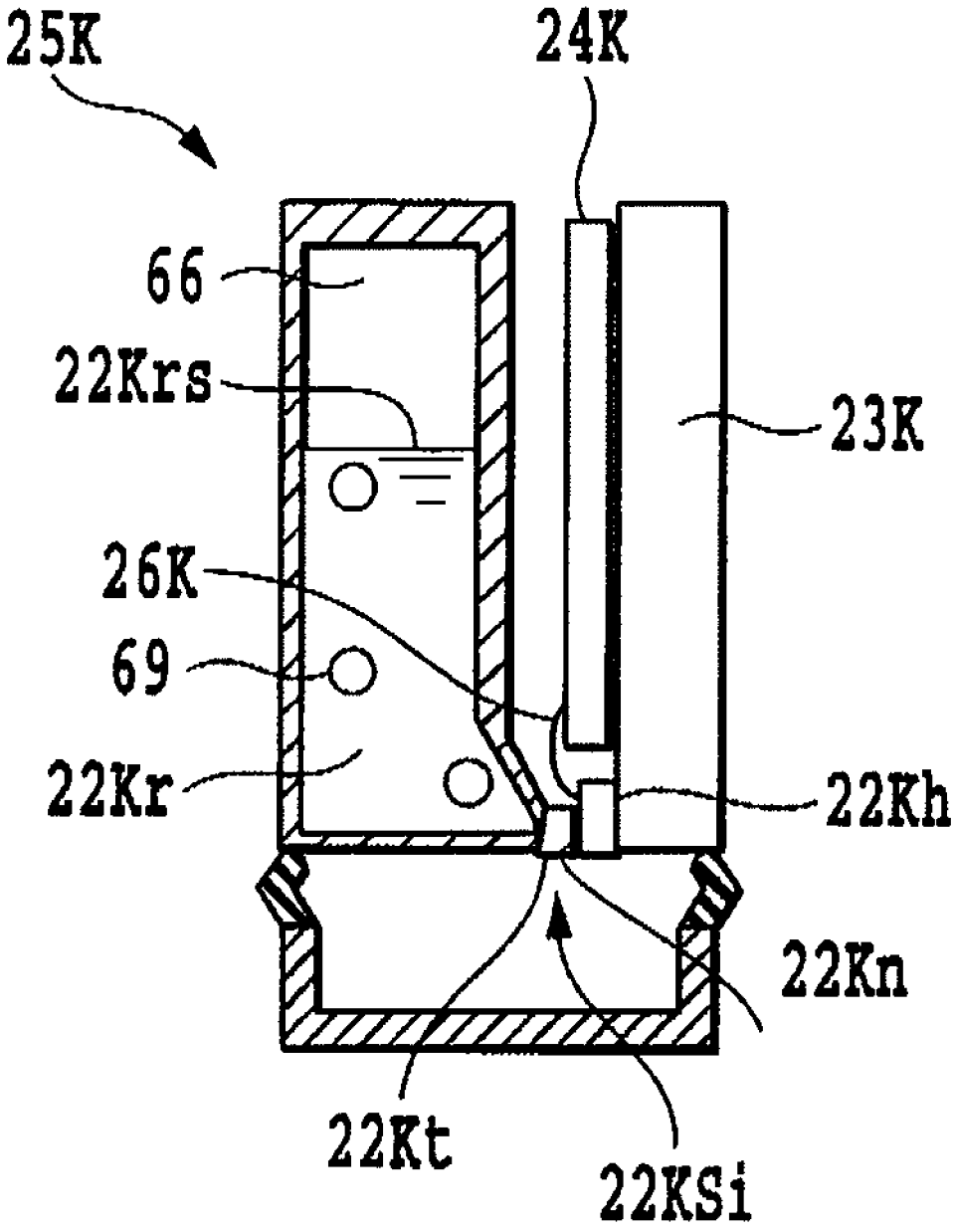
FIG. 8 is a cross section taken along line VIII-VIII in FIG. 6.

FIG. 8 is a cross section taken along line VIII-VIII in FIG. 6.

The nozzle 22Kn in the ejection portion 22KSi is formed by connecting two chips of a heater board 22Kh and a supply port forming member 22Kt. The supply port forming member 22Kt is in contact with a liquid chamber 25K forming the reservoir 22Kr and is communicated with an ink passage of the supply port forming member 22Kt. The heater board 22Kh and a head base plate 24K are wire-connected by a power supply wire 26K to exchange signals between the head unit 22K and an outside base plate. The ejection portion 22KSi, the head base plate 24, the liquid chamber 25K and the like are fixed to a base plate 23K by a device (not shown).

However, at the time of the printing operation or the standby, air bubbles 69 may be mixed into the reservoir 22Kr due to separation of dissolved gases in the ink or an ink supply operation. It should be noted that the dissolved gas in the ink means air dissolved in the ink and more gases are generally dissolved into the ink as a temperature is lower. One example where such gas is separated during the printing includes a case where a temperature of the ink increases by heat of the heater provided in the ejection portion 22KSi due to transfer of the ink toward the ejection portion 22KSi during a printing operation. One example where the air bubble is contained in the supply ink into the reservoir 22Kr includes gas transmission in the supply passage 62. The supply passage 62 is usually filled with the ink, but in a case of forming the supply passage 62 with a tube or the like, the air in the atmosphere passes through the tube and is mixed inside the tube with an elapse of time.

Such air bubble 69 is mixed into the liquid chamber 22Kr due to the ink supply operation. Such bubble 69 is reserved to accumulate therein and finally causes a phenomenon of raising a problem with a print quality, such as closure of the ink supply passage. Therefore, there is conventionally adopted a method where the ink which does not contribute to the print is discharged at predetermined intervals and at the same time, the air bubble 69 is discharged to perform removal of the air bubble or the air bubble accumulated and remained is pushed back to a predetermined position (for example, ink tank).

The inkjet printing apparatus in the present embodiment is formed so that the air bubble can move upwards due to the self-buoyant force in a passage from a contact face between the supply port forming member 22Kt and the liquid surface 25K to the ink liquid surface 22Krs (the ink passage is not blocked by the bubble).

The air bubble 69 mixed in the reservoir 22Kr moves upwards and also reaches the ink liquid surface 22Krs, disappearing therein (hereinafter, referred to as gas-liquid separation). Since an ink amount in the reservoir 22Kr is maintained within a constant range, the air bubble 69 gas-liquid separated is not accumulated or remain in the air chamber 66 at the upper side of the reservoir 22Kr. The air bubble 69 may be attached on a wall surface or the like, but since such bubble 69 is fine in size, it has no adverse effect, such as the closing of the passage. In a case where the air bubble 69 becomes large, it is away from the wall surface to be gas-liquid separated.

As described above, in the inkjet printing apparatus of the present embodiment, since the removal of the air bubble 69 is automatically performed in a regular operation cycle such as printing operation or standby time, the sequence for the air bubble removal is not required to be carried out particularly.

However, since the nozzle 22Kn is constructed of an extremely fine passage, the air bubble 69 may not appear in the reservoir 22 Kr through the supply port forming member 22Kt, and remain in the ejection portion KSi. In this case, the air bubble 69 is discharged by the nozzle 22Kn with discharge of the ink due to the above cleaning operation. However, a large part of the air bubbles 69 is, as described above, removed in the regular operation. Therefore, here only a small amount of the air bubbles 69 remaining in the ejection portion 22KSi is removed. Since the small amount of these air bubbles 69 exist in the vicinity of the nozzle 22Kn, the air bubble 69 can be removed with a small amount of the ink discharged by the cleaning operation.

The reservoir 22Kr as described above is constructed so as to have no obstacle to the air bubble flow in a route from the nozzle 22Kn to the liquid surface 22Krs, but not limited thereto, may have the construction as explained below.

Figure 9:
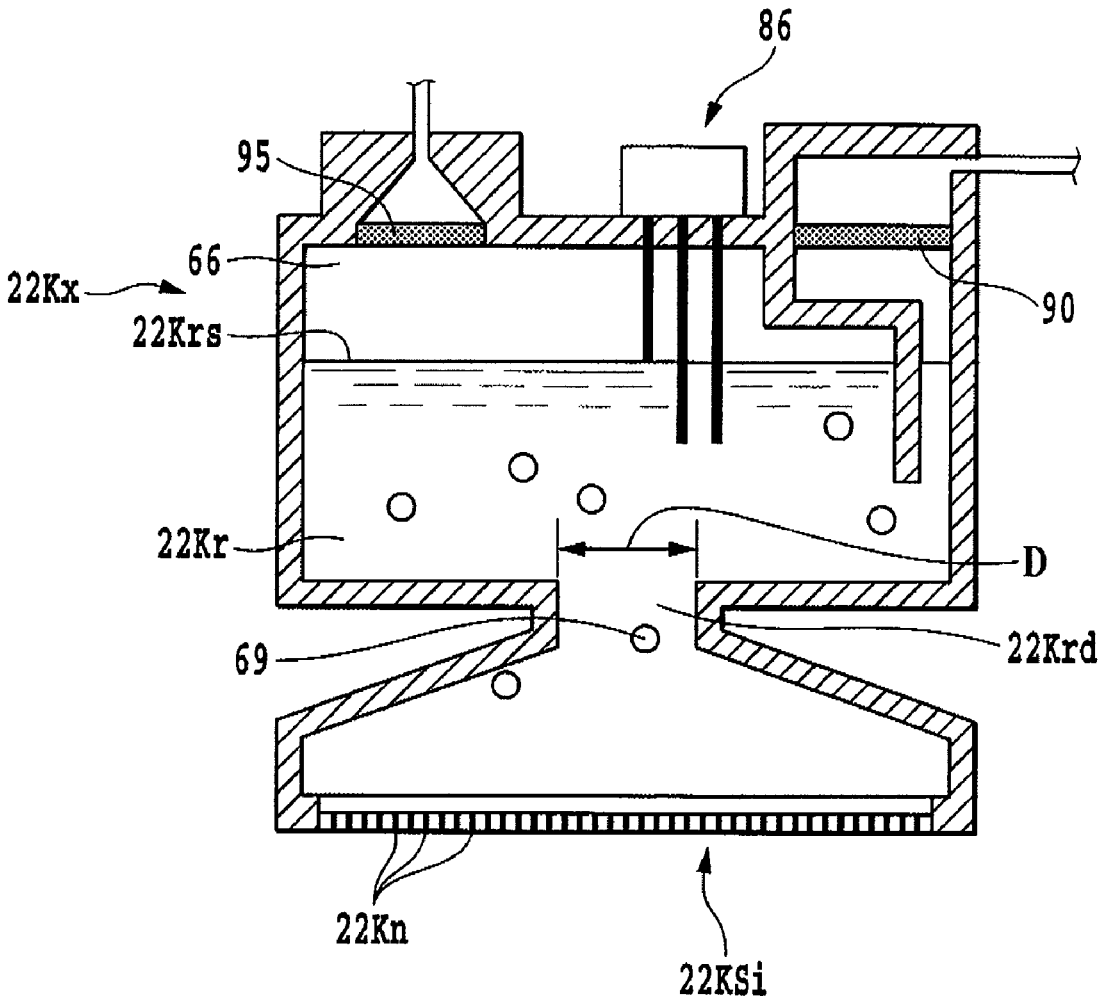
FIG. 9 is a diagram illustrating a head unit which is a modification in the first embodiment.
Figure 10:
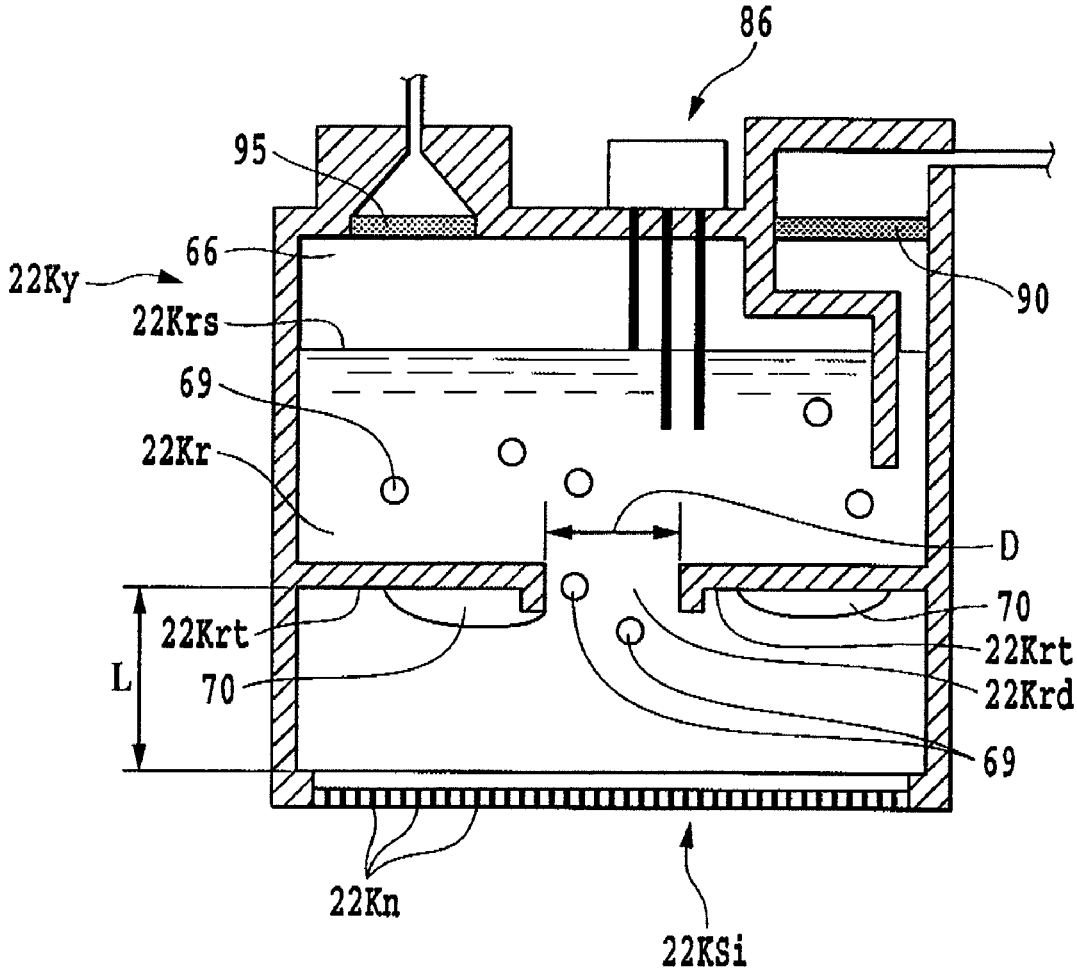
FIG. 10 is a diagram illustrating a head unit which is a modification in the first embodiment.

FIGS. 9 and 10 are diagrams each illustrating a head unit 22Kx and a head unit 22Ky as modifications of the present embodiment. The head unit 22Kx has the reservoir 22Kr provided with a partition forming a passage between the ejection portion 22KSi and the ink liquid surface 22Krs. Since this passage has an interval D larger than a diameter of the air bubble 69 generated, this partition does not interrupt rising of the air bubble 69 due to the buoyant force and the air bubble 69 reaches the ink liquid surface 22Krs to be gas-liquid separated therein.

The head unit 22Ky likewise has the reservoir 22Kr provided with a partition forming a passage between the ejection portion 22KSi and the ink liquid surface 22Krs. The partition is provided with the reservoir 22Krt where a part of the air bubbles remains. The reservoir 22Krt is constructed so that the remaining air bubbles 70 are partially separated before the bubbles are accumulated as much as to close the ink passage. Further, this partition is provided with a narrow portion Krd having an interval D larger than a diameter of the air bubble 69 separated. Inconsequence, the separated air bubble 69 rises to the ink liquid surface 22Krs and is gas-liquid separated therein.

It should be noted that the present modification shows an example where the head unit and the partition are constructed integrally, but not limited thereto, may be constructed separately.

In this way, the gas-liquid separation is possible by the construction where the air bubbles generated in the ejection portion or the reservoir can rise to the liquid surface, and the bubbles are not accumulated or remain in the head unit by performing the negative pressure control by the fan and at the same time, discharging the bubbles. Therefore, the cleaning execution frequency for removal of the air bubble can be reduced and at the same time, an ejection amount of the ink which does not contribute to the print can be restricted. The printing speed is faster by reduction of the cleaning execution frequency.

In consequence, by using the inkjet printing apparatus of the present embodiment, there are realized an ink supplying apparatus and an inkjet printing apparatus which can simplify the negative pressure control of the ink supplied to an ejection portion of the ink, thereby achieving the cost-down by simplifying the apparatus construction.

(Second Embodiment)

Hereinafter, a second embodiment in the present invention will be explained with reference to the drawings.

Figure 11B:
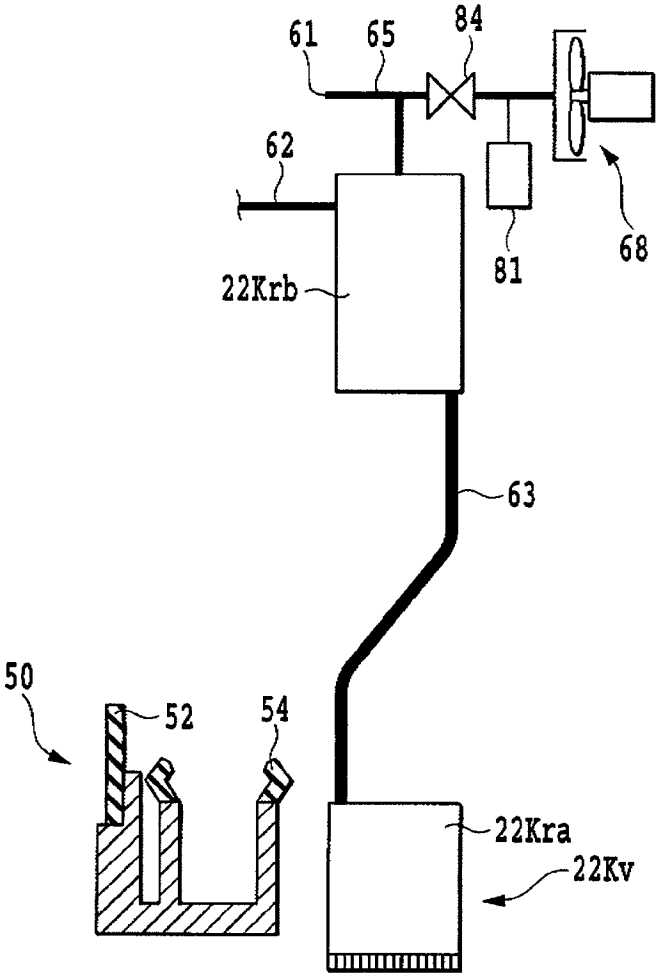
FIG. 11B is a diagram illustrating the head unit in the second embodiment.
Figure 11A:
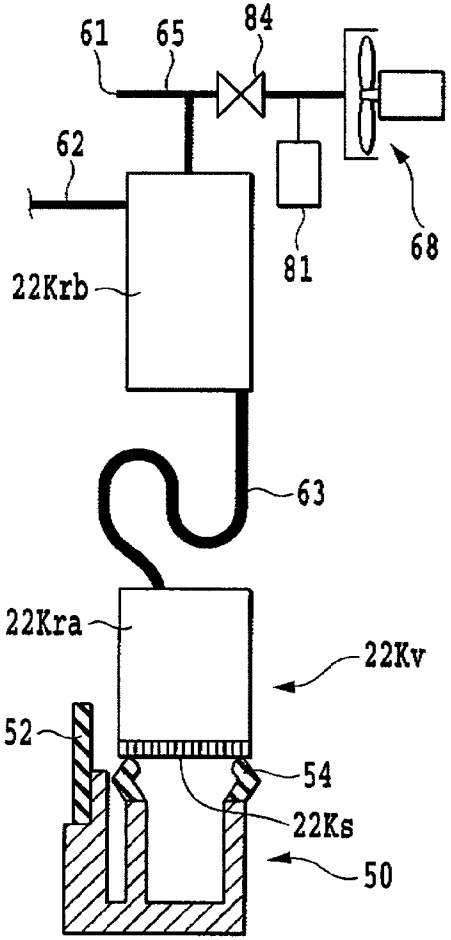
FIG. 11A is a diagram illustrating a head unit in a second embodiment.

FIGS. 11A and 11B are diagrams each illustrating a head unit in the present embodiment. A reservoir of the head unit in the present embodiment is constructed to be divided into a second reservoir in contact with an ejection portion and a first reservoir for performing gas-liquid separation of air bubbles. FIG. 11A is a diagram illustrating a state where the ejection portion is capped and FIG. 11B is a diagram illustrating a state where the ejection portion is not capped.

A second reservoir 22Kra is in contact with the ejection portion to form a printing head portion 22Kv. The second reservoir 22Kra and the first reservoir 22Krb are connected through an intermediate tube 63. The first reservoir 22Krb is connected to a pressure reducing mechanism formed of the fan 68 and the like which is the construction similar to that of the first embodiment and the ink supply passage 62. The first reservoir 22Krb is fixed to a main body frame and the printing head portion 22Kv moves relative to the first reservoir 22Krb at the time of transfer by a printing operation, a capping operation or the like.

Figure 12A:
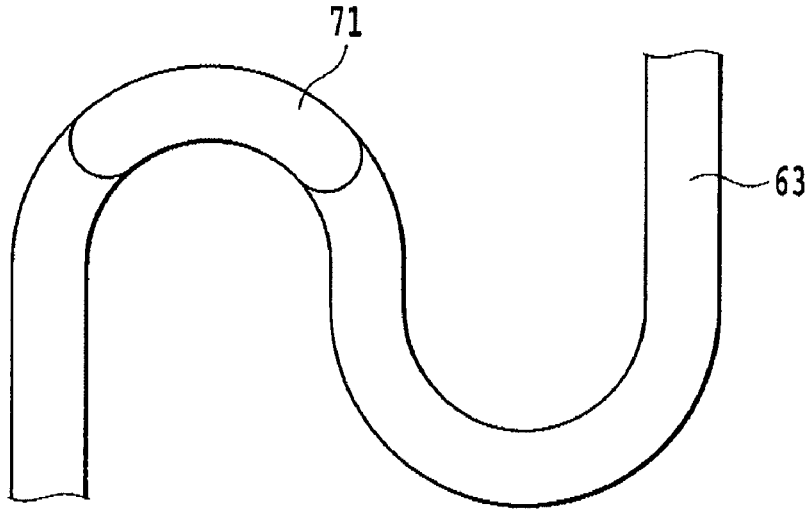
FIG. 12A is an enlarged diagram illustrating an intermediate tube.
Figure 12B:
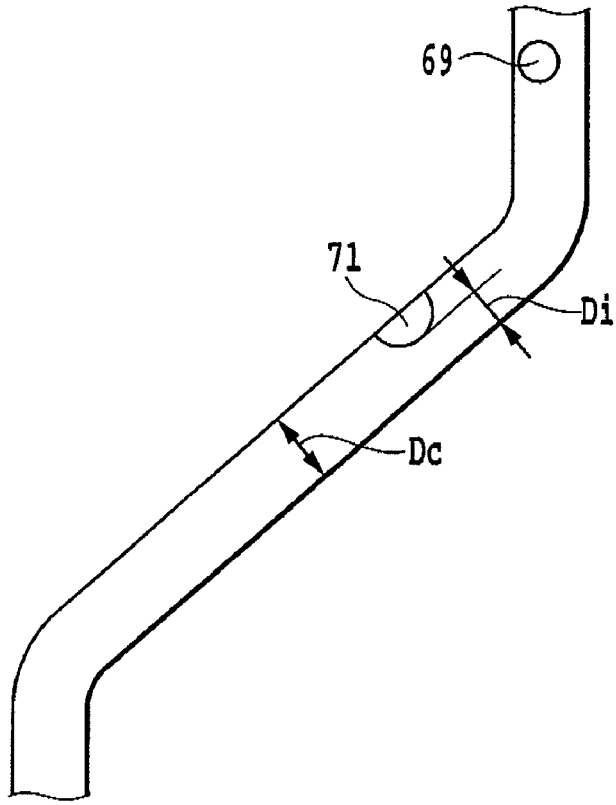
FIG. 12B is an enlarged diagram illustrating the intermediate tube.

FIGS. 12A and 12B are enlarged diagrams each illustrating the intermediate tube 63. As shown in FIG. 11A, when the printing head portion 22Kv is in a capping position, since the printing head portion 22Kv comes relatively to the first reservoir 22Krb, the intermediate tube 63 is bent to form a part in a reverse U-shape. Therefore, as shown in FIG. 12A, air bubbles generating and rising in the second reservoir 22Kra during the capping or printing operating may form an air bubble pool 71 in the part at the reverse U-shape to close the ink passage.

However, as shown in FIG. 11B, when the printing head portion 22Kv again moves downwards by the printing operation (leaves away relatively from the first reservoir 22Krb), the part in the reverse U-shape of the intermediate tube 63 disappears. In consequence, the air bubbles 69 generated in the second reservoir 22Kra continuously rise, so that the intermediate tube 63 is communicated with the first reservoir 22Krb. As shown in FIG. 12B, the air bubble 69 is separated from the air bubble pool 71 and rises due to the self-buoyant force. Particularly, since an ink passage diameter Dc of the intermediate tube 63 is larger than a diameter of the air bubble 69 to be separated, the air bubble 69 reaches the first reservoir 22Krb and is gas-liquid separated therein as explained in the first embodiment.

Therefore, even if the air bubble pool 71 blocks off the ink passage at capping, the ink passage is not blocked off at the printing operation time of actually ejecting the ink. At this time, a part of the air bubble pool 71 may possibly remain in the intermediate tube 63, but in consideration of this event, a diameter Dc of the intermediate tube 63 may be set so as to secure the minimum ink passage Di.

For replacing the ink exposed to an atmosphere in the opening of the nozzle 22Kn for new ink before the printing head portion 22Kv moves from a capping position to a printing operation, the ink may be ejected into the cap 50. In this case, since the ink passage is blocked by the air bubble pool 71, an amount of the negative pressure in the second reservoir 22Kra increases, but in a case where an ejection amount is small, since the air bubble pool 71 itself moves so as to be pulled to the side of the second reservoir 22Kra or expands by itself, no problem occurs.

As explained in the first embodiment, the complicate control is not required for pressure adjustment corresponding to the pressure changing at each ejection, and for generating an appropriate negative pressure, since the air in the first reservoir is indirectly sucked, the ink is difficult to increase in viscosity.

In consequence, by using the inkjet printing apparatus of the present embodiment, there are realized an ink supplying apparatus and an inkjet printing apparatus which can simplify the negative pressure control of the ink supplied to an ejection portion of the ink, thereby achieving the cost-down by simplifying the apparatus construction.

(Third Embodiment)

Hereinafter, a third embodiment in the present invention will be explained with reference to the drawings.

Figure 13:
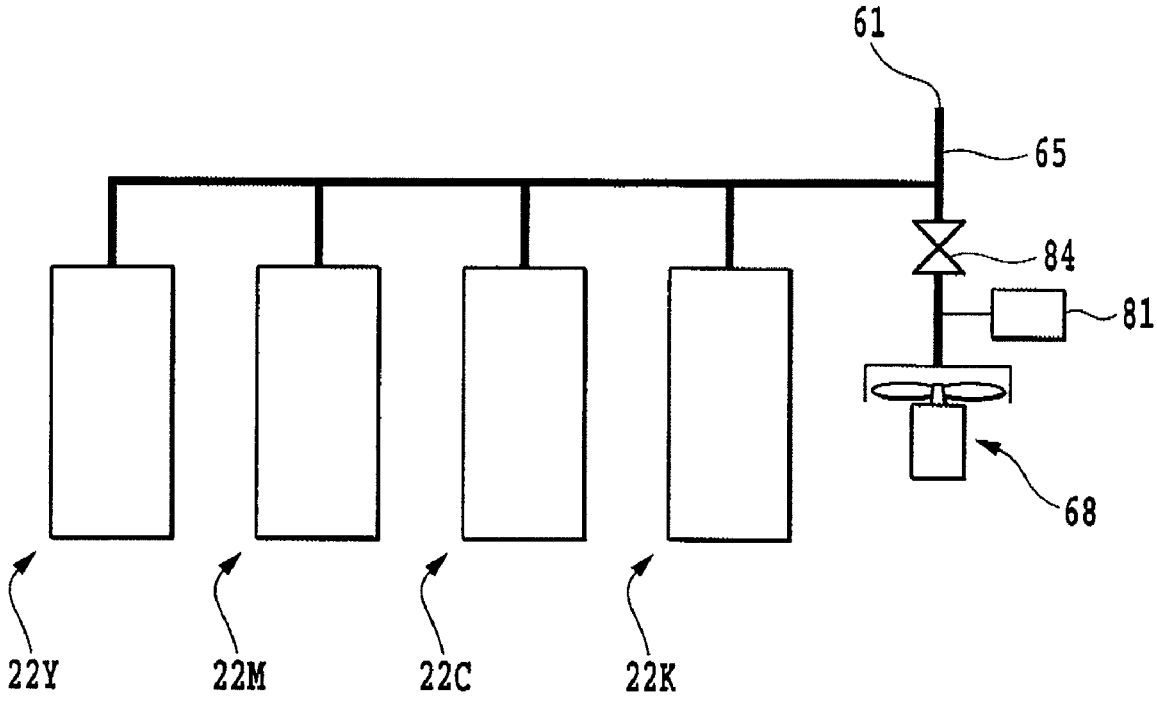
FIG. 13 is a diagram illustrating a head unit and the surroundings thereof in a third embodiment.

FIG. 13 is a diagram illustrating a head unit and the surroundings in the present embodiment. A negative pressure control device by the fan 68 may be connected to the plurality of the head units 22*y*, 22M, 22C and 22K as in the case of the present embodiment.

Figure 14:
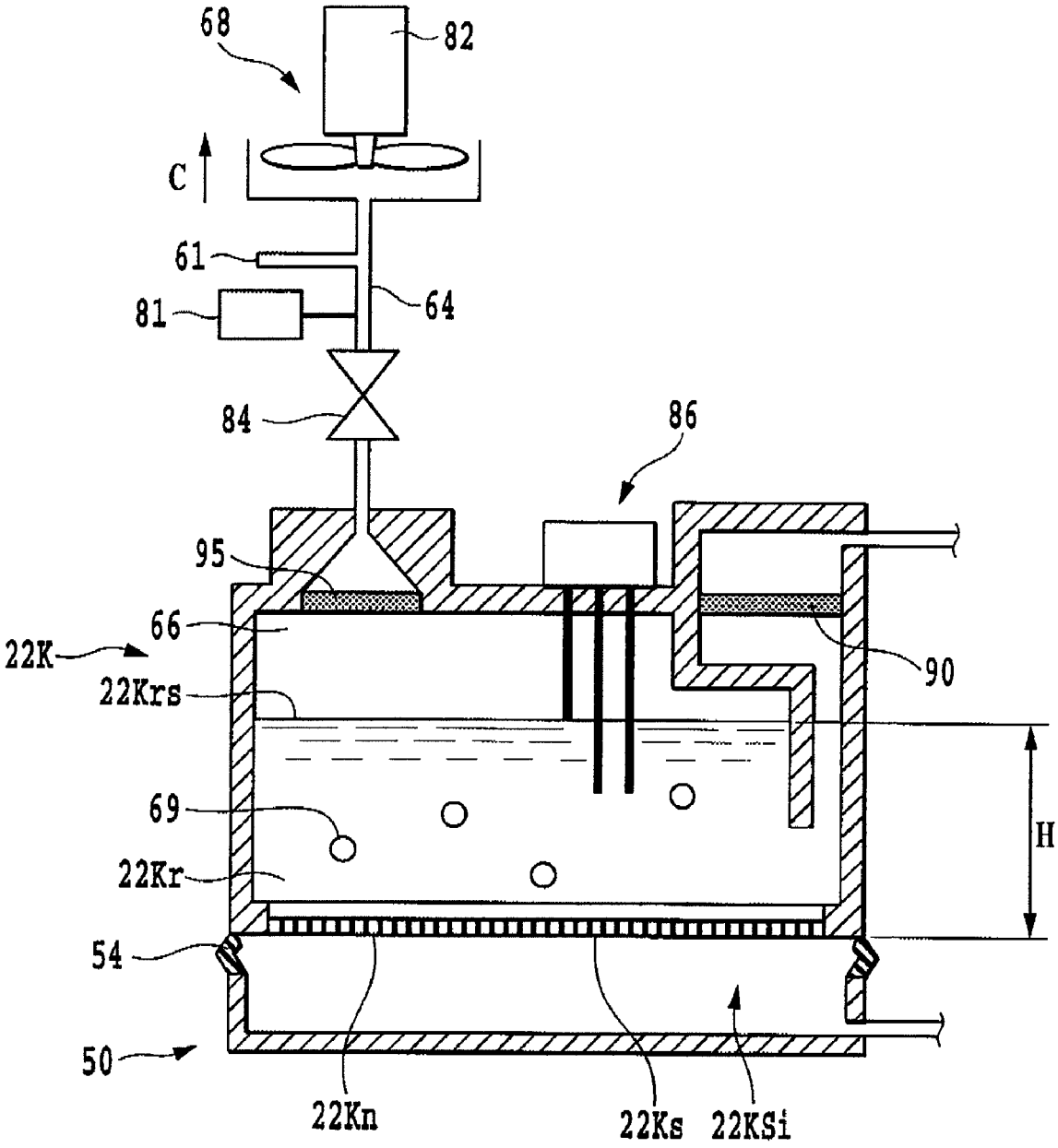
FIG. 14 is a diagram illustrating a head unit and the surroundings thereof in the third embodiment.

FIG. 14 is a diagram illustrating an embodiment different from the present embodiment in FIG. 13. In the each aforementioned embodiment, the flow of the air from the suction port 61 communicating with an atmosphere to the fan 68 is a straight-line flow. However, the flow of the air is not limited thereto, but as shown in FIG. 14, the flow of the air from the air chamber 66 to the fan 68 may be a straight-line flow and the suction port 61 communicated with an atmosphere may be provided in the midway of such straight-line flow. Here, the air passage 64 has a portion which is a first passage communicated with the air chamber 66 via the air valve 84. The air passage 64 has a portion which is a second passage communicated with the fan 68. A portion which is communicated with the air passage 64 and is opened to an atmosphere is a third passage. In this case, the first passage and the second passage are linearly connected and the communication portion is further communicated (connected) with the third passage.

Figure 15:
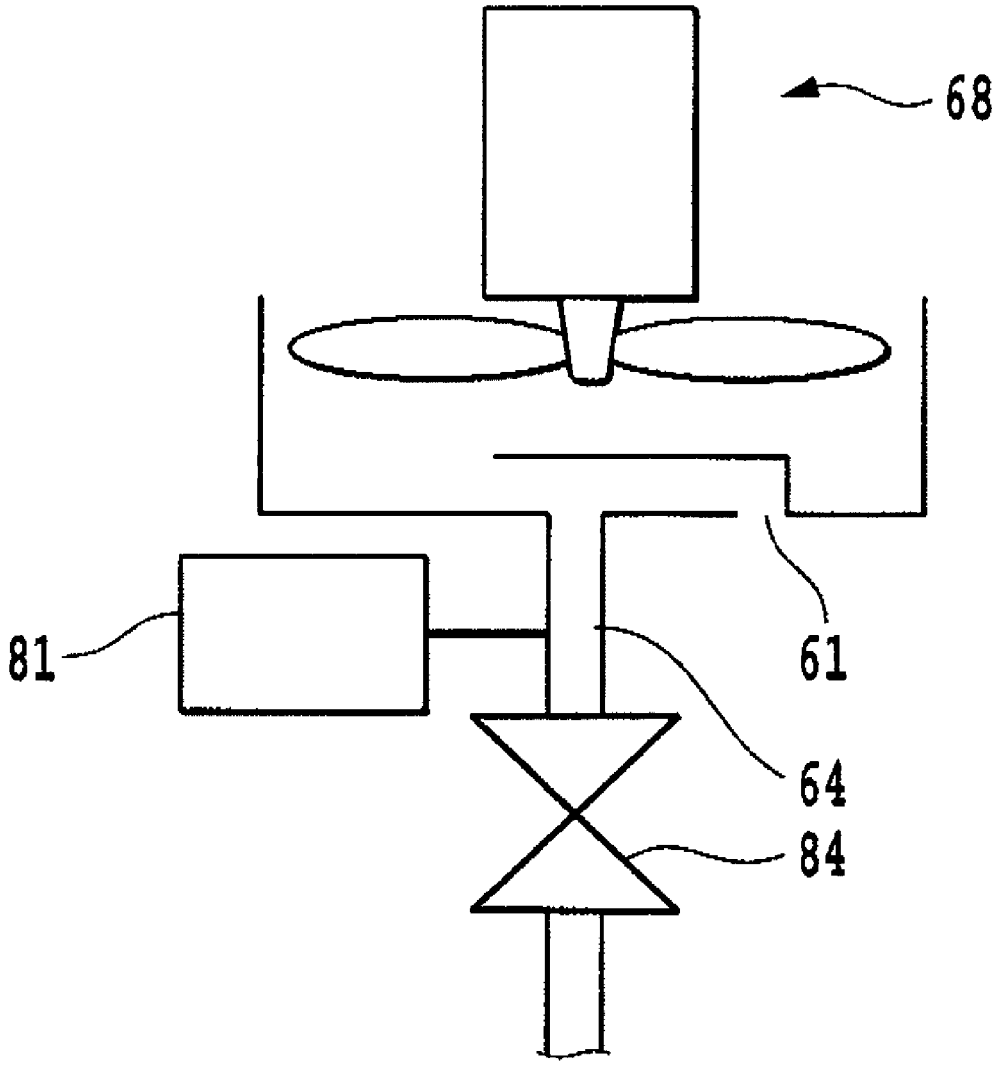
FIG. 15 is a diagram illustrating a head unit and the surroundings thereof in the third embodiment.

Each of the first, second and third passages is not limited to a single one, but for example, the plural third passages may be provided, the passage is branched in the midway or an end of the passage may be branched. In addition, the passage or the end may be partitioned by a wall, which has a single or plural communicating holes. As shown in FIG. 15, a casing of the fan may be provided with a communicating opening with an atmosphere to form an air passage into which air is introduced from the air passage communicated with an atmosphere, thus sucking the air through the air passage. The number of the fans may be plural. In any case, it is apparent that the effect of the present invention can be obtained as long as the air is introduced from the air passage communicated with an atmosphere by a suction force of the fan and the air is sucked through the air passage, thereby reducing the pressure in the head unit.

Figure 16:
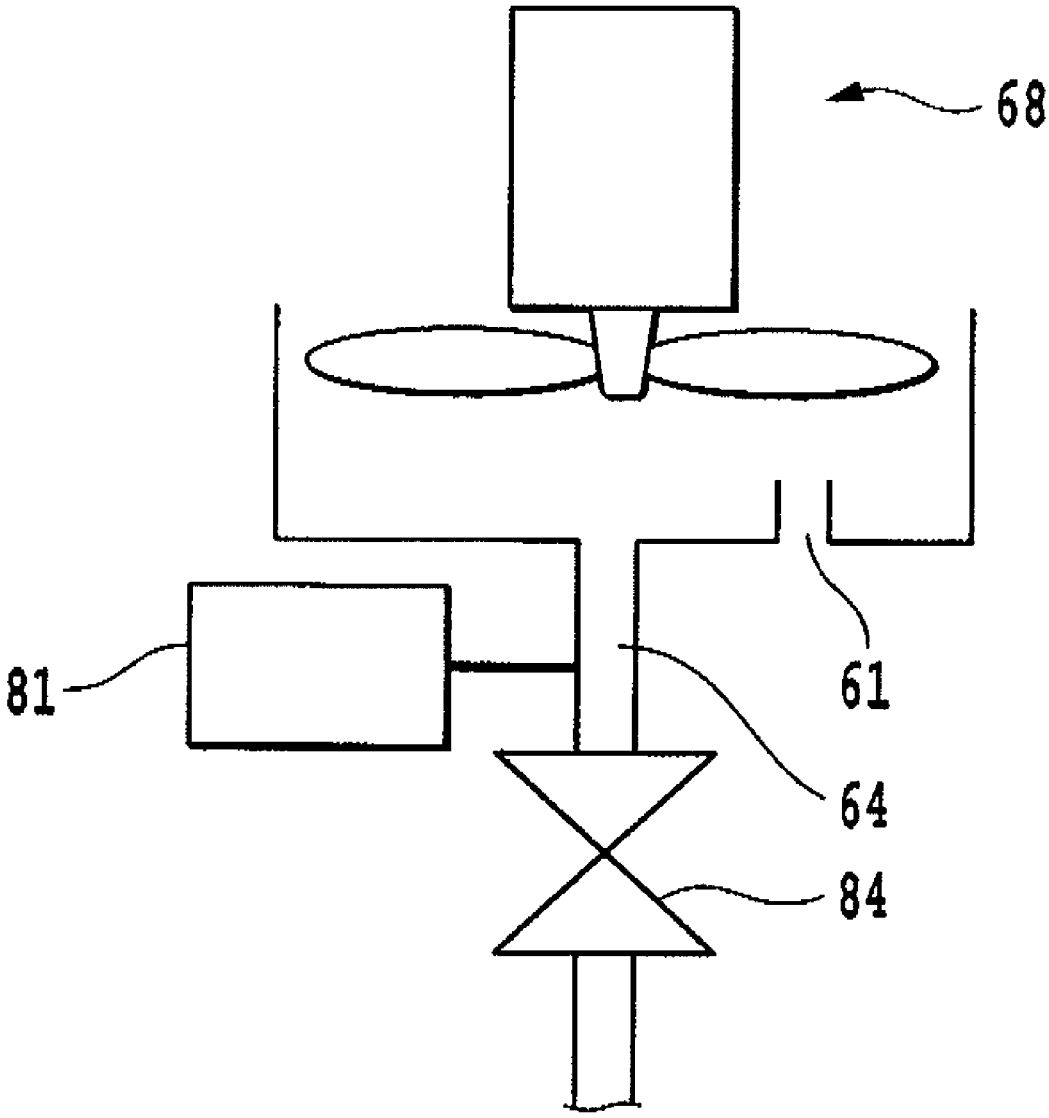
FIG. 16 is a diagram illustrating a head unit and the surroundings thereof in the third embodiment.

As shown in FIG. 16, the casing of the fan may be provided with a communicating opening with an atmosphere and may be provided with an air passage at a different location from the communicating opening. This air passage is communicated with the air chamber 66 via the air valve 84 in the air passage 64. In this construction, the air is not sucked through the air passage, but the air is introduced from the communicating opening communicated with an atmosphere to provide a buffer effect to the pressure fluctuation in the air chamber 66. Therefore, the present embodiment has an effect of stabilizing the negative pressure in the air chamber 66 as described above.

In this construction, there are realized an ink supplying apparatus and an inkjet printing apparatus which can simplify the negative pressure control of the ink supplied to an ejection portion of the ink, thereby achieving the cost-down by simplifying the apparatus construction.

The each above embodiment shows an example where the control section for controlling the negative pressure in the head unit is provided in the printing apparatus, but is not limited thereto and may be provided in the head unit as an ink supplying apparatus.

In the above embodiment, the first reservoir and the second reservoir are connected by the intermediate tube and the intermediate tube serves as the supply of the ink and also the passage of the bubbles moving from the second reservoir to the first reservoir, but this construction is not limited thereto. In addition to the ink supply passage for supplying the ink from the first reservoir to the second reservoir, a communicating passage may be provided for leading bubbles generated in the second reservoir to the first reservoir.

(Fourth Embodiment)

Hereinafter, a fourth embodiment in the present invention will be explained with reference to the drawings.

Figure 17:
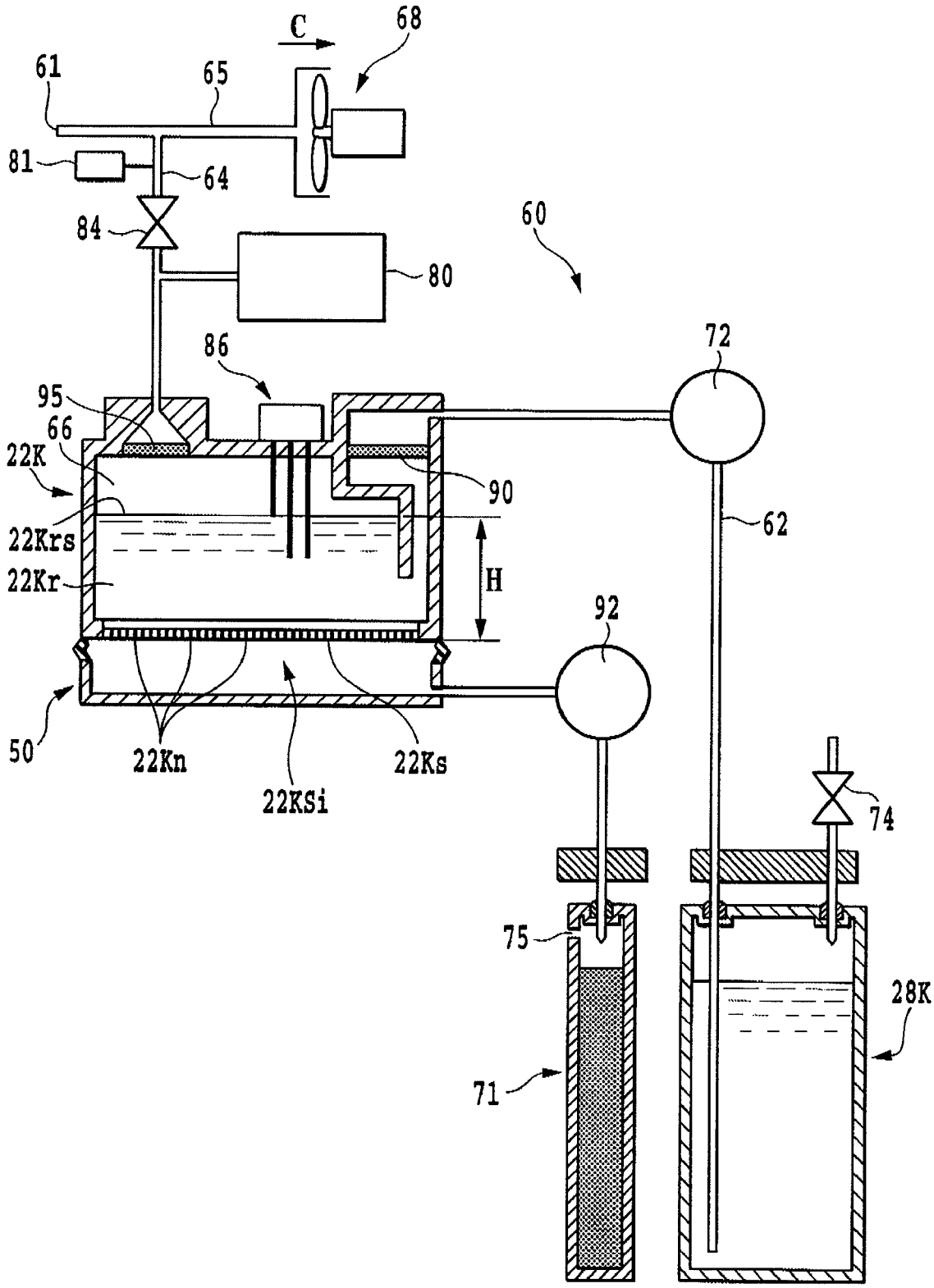
FIG. 17 is a diagram schematically illustrating an ink route from an ink tank to a head unit in a fourth embodiment.

FIG. 17 is a schematic diagram illustrating a route of ink flow from the ink tank 28K to the head unit 22K in the present embodiment. A basic construction is the same as that of the ink supplying apparatus 60 as explained in FIG. 3, and is different in a point where a pressure holding mechanism 80 is connected to a portion between the valve 84 and the air chamber 66 in the air passage 64.

Here, the pressure holding mechanism 80 will be explained. As described above, at a standby time of the printing operation in the printing apparatus, the air passage 64 communicating the air chamber 66 of the head unit 22K with an atmosphere is blocked by the valve 84. Further, at the standby time, the ink passage 62 between the head unit 22K and the side of the ink supplying unit including the ink tank 28K is blocked by the supply pump 72. Therefore, an inside of the head unit 22K at such standby time forms a closed system other than the ejection opening of the nozzle 22Kn.

In a case where a temperature change occurs at the standby time forming such closed system, the air in the air chamber 66 expands or contracts. Therefore, the meniscus of the ink formed in the ejection opening of the nozzle 22Kn is possibly destroyed. In addition, in a case where the temperature is increased to expand a volume of the air in the air chamber 66, the ink may be leaked from the ejection opening of the nozzle 22Kn to form an ink pool in the ejection opening forming face 22Ks. In an extreme case, the leaked ink may be leaked from the cap 50 to an outside. On the other hand, in a case where the temperature is lowered, the volume of the air in the air chamber 66 is contracted, thereby possibly pulling the air from the ejection opening of the nozzle 22Kn into the inside. In a case of assuming such an event, a cleaning operation as described above is necessary before the printing operation. The cause of the temperature change of the head unit 22K at the standby time is considered to include a change of an outside air temperature and in addition thereto, for example, an influence of remaining heat of the ink, heat generation of the base plate in the standby mode or the like.

Figure 18A:
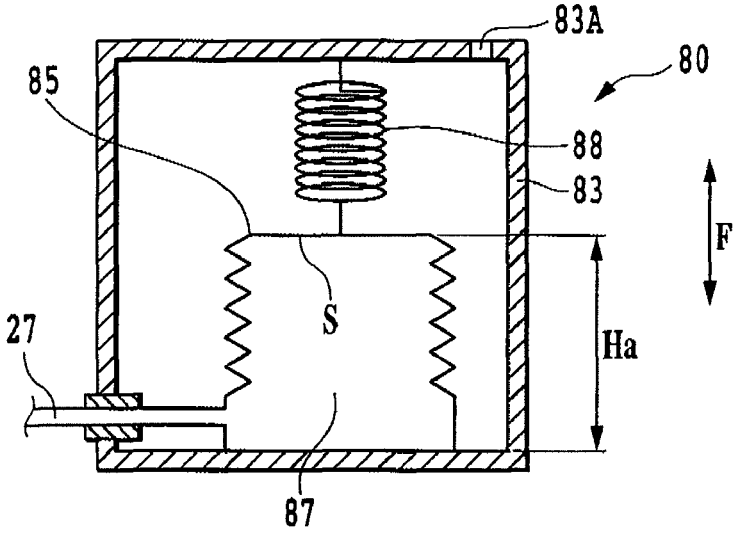
FIG. 18A is a schematic construction diagram illustrating a pressure holding mechanism.
Figure 18B:
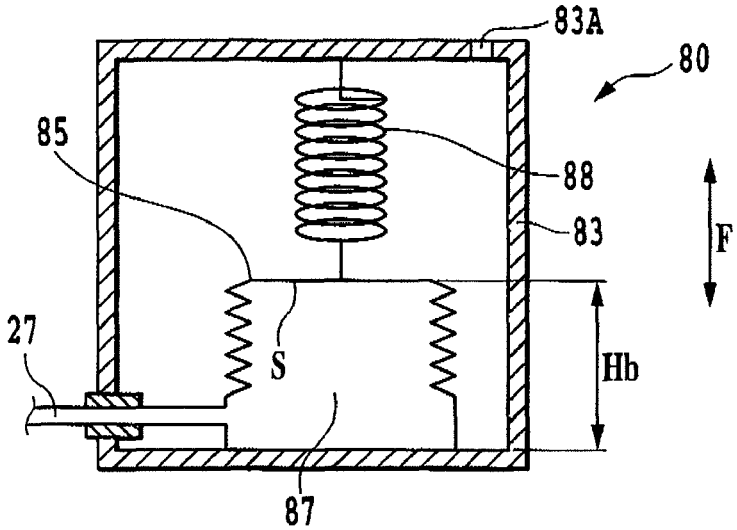
FIG. 18B is a schematic construction diagram illustrating the pressure holding mechanism.

FIGS. 18A and 18B are simplified construction diagrams each illustrating the pressure holding mechanism 80. This pressure holding mechanism 80 is connected via a pressure holding passage 27 to the air passage 64 (refer to FIG. 17).

Numeral 83 shows a casing constituting a main body of the pressure holding mechanism 80 and the inside of the casing is communicated through an air communicating opening 83A to an atmosphere. A bottom portion of a flexible bag 85 is fixed on the inside of the casing 83, and an inside of the flexible bag 85 is communicated with a pressure holding passage 27. The flexible bag 85 forms a bag-inside space 87 closed other than a connection portion with the pressure holding passage 27. The flexible bag 85 has a volume changing with a pressure in the space 87 and is formed in a bellows shape so as to be extensible in an upward-downward direction in this example. A tension spring 88 is provided in the casing 83 for urging an upper side of the flexible bag 85 upwards. When the spring 88 pulls up the upper side of the flexible bag 85 by a predetermined urging force, the flexible bag 85 is smoothly deformed in an upward-downward, F direction in accordance with a pressure in the space 87. That is, the flexible bag 85 in this example is deformed in an F direction in accordance with an extremely small pressure change in the space 87 to restrict the deformation in a direction other than the F direction by an external force applied from a side of the flexible bag 85.

FIG. 18A shows a state where the space 87 in the flexible bag 85 is communicated with an atmosphere, that is, a state where the pressure holding mechanism 80 is not subjected to external factors. That is, the fan 68 is stopped and also the valve 84 is opened, so that the bag-inside space 87 is communicated with an atmosphere through the pressure holding passage 27 and the air passage 64. When the bag-inside space 87 is thus in an atmospheric pressure, a height Ha of the flexible bag 85 corresponds to a length slightly longer than a free length of the flexible bag 85 in accordance with a pulling-up force of the spring 88. Here the free length of the flexible bag 85 is a length when the flexible bag 85 is put in a stand-alone state without an application of an external force including a spring force of the spring 88. Since the spring 88 serves in such a manner as to extend the flexible bag 85 in a free-length state upwards, the height Ha corresponds to a length longer than the free length of the flexible bag 85. Hereinafter, the height Ha of the flexible bag 85 is also called a counterbalance position Ha.

FIG. 18B shows a state of the pressure holding mechanism 80 during a printing operation. At a printing operation time, as described above, a pressure in the air passage 64 is reduced to be lower than an atmospheric pressure by a function of the fan 68 and the reduced pressure (negative pressure) is introduced through the valve 84 into the air chamber 66. Accordingly, the bag-inside space 87 is reduced in pressure in the same way as the air passage 64, and the flexible bag 85 is contracted downwards against the force of the spring 88. At this time, the force acting in such a manner as to push down a top surface portion of the flexible bag 85 corresponds to a value found by multiplying an area S of the top surface portion of the bag-inside space 87 by a pressure (pressure reducing amount) reduced by the fan 68.

A height Hb of the flexible bag 85 corresponds to a length when a force which contracts down the flexible bag 85 by the reduced pressure, a force of the spring 88 which extends upwards the flexible bag 85, and a force by which the flexible bag 85 returns back to the self-free length are balanced. The force of the spring 88 which extends upwards the flexible bag 85 increases as the height Hb is shortened by contracting downwards the flexible bag 85. Hereinafter, the height Hb of the flexible bag 85 is also called a counterbalance position Hb.

Figure 18C:
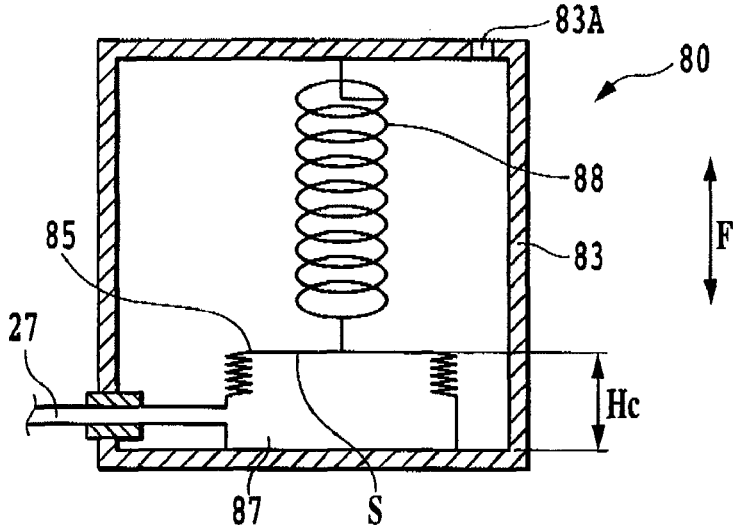
FIG. 18C is a schematic construction diagram illustrating the pressure holding mechanism.

FIG. 18C shows a state where the bag-inside space 87 is largely reduced in pressure and the flexible bag 85 is contracted downwards to the limit. The height Hc of the flexible bag 85 at this time is also called a counterbalance position Hc.

Next, a function of the pressure holding mechanism 80 will be explained. When the air chamber 66 in the head unit 22K is reduced in pressure during a pressure reducing process by the fan 68 including a printing operation time, the bag-inside space 87 is reduced in pressure as described above where the flexible bag 85 is maintained in the counterbalance position Hb in FIG. 18B. After such pressure reducing process is executed, when the printing operation is shifted to a standby state where the valve 84 is closed to stop the fan 68, the flexible bag 85 is maintained substantially in the counterbalance position Hb.

The reason for it is that at the standby time when the valve 84 is closed, the inside of the head unit 22K, as described above, forms a closed system other than the ejection opening of the nozzle 22Kn and the bag-inside space 87 does not pull in the air from an outside and forms a part of the closed system. That is, although the system of the inside in the head unit 22K is communicated with an atmosphere via the ejection opening of the nozzle 22Kn, the meniscus of the ink is formed in the ejection opening. Therefore, as long as a difference between a pressure in the system of the inside of the head unit 22K and the atmospheric pressure is within a range to the extent that it does not destroy the meniscus, discharge of the ink and suction of the outside air from the ejection opening of the nozzle 22Kn are prevented. In consequence, the system of the inside in the head unit 22K can be assumed as a closed space. Therefore, by closing the valve 84 after executing the pressure reducing process, the flexible bag 85 results in being substantially maintained in the counterbalance position Hb in FIG. 18B.

Since the bag-inside space 87 is in a pressure reducing state at a standby time when the flexible bag 85 is in the counterbalance position Hb in FIG. 18*b*, the system of the inside in the head unit 22K including the inside of the nozzle 22Kn is maintained in a negative pressure state.

In a case where a temperature in the above closed system increases at such standby time, the air in the closed system, that is, the air in the air chamber 66, in the bag-inside space 87, in the air passage 64, and the like expands. When the pressure in the closed system is increased by such expansion of the air (negative pressure reduces), the pressure corresponding to such increased amount acts in such a manner as to push out the ink from the nozzle 22Kn to an outside. In the present embodiment, however, the pressure (negative pressure) in the closed system can be maintained by the function of the pressure holding mechanism 80.

That is, when the air in the closed system expands, the flexible bag 85 extends at a position higher than the counterbalance position Hb so as to increase the volume of the bag-inside space 87, thereby absorbing a volume expansion amount of the air. However, the position at which the flexible bag 85 expands upwards is equal to or lower than the counterbalance position Ha. In this way, when the flexible bag 85 extends at a position higher than the counterbalance position Hb, a spring force of the spring 88 and a force of the flexible bag 85 by which the flexible bag 85 returns back to the free length by itself act in such a manner as to push up the inner top surface of the flexible bag 85. Such upward extension of the flexible bag 85 causes the negative pressure in the closed system to be maintained. In the process where the air in the closed system expands, an operational length (extending amount) of the spring 88 is shortened, thereby weakening the force of pulling up the inner top surface of the flexible bag 85 upwards. Therefore, as such upward extending amount of the flexible bag 85 is larger, an absorption amount of the negative pressure in the closed system to the unit extending amount is the lower.

In a case where a temperature in the above closed system decreases, the air in the closed system, that is, the air in the air chamber 66, in the bag-inside space 87, in the air passage 64 and the like contracts. When the pressure in the closed system is decreased by such contraction of the air (negative pressure increases), the pressure corresponding to such decreased amount acts in such a manner as to suck the outside air from nozzle 22Kn. In the present embodiment, however, the pressure (negative pressure) in the closed system can be maintained by the function of the pressure holding mechanism 80.

That is, when the air in the closed system contracts, the flexible bag 85 contracts at a position lower than the counterbalance position Hb so as to decrease the volume of the bag-inside space 87, thereby absorbing a volume contraction amount of the air. However, the position at which the flexible bag 85 contracts downwards is equal to or higher than the counterbalance position Hc. In this way, when the flexible bag 85 contracts at a position lower than the counterbalance position Hb, a spring force of the spring 88 and a force of the flexible bag 85 by which the flexible bag 85 returns back to the free length by itself act in such a manner as to push up the inner top surface of the flexible bag 85. Such downward contraction of the flexible bag 85 causes the negative pressure in the closed system to be maintained. In the process where the air in the closed system contracts, an operational length (extending amount) of the spring 88 is lengthened, thereby strengthening the force of pulling up the inner top surface of the flexible bag 85 upwards. Therefore, as such downward contracting amount of the flexible bag 85 is larger, an absorption amount of the negative pressure in the closed system to the unit contracting amount is the larger.

As explained above, the negative pressure in the closed system is maintained by absorbing the expansion and the contraction of the air in the closed system with a volume change of the bag-inside space 87. The negative pressure in the closed system maintained when the flexible bag 85 contracts to the limit position of the counterbalance position Hc in FIG. 18C may be preferably set in such a manner as not to reach a value as large as to destroy the meniscus of the ink formed in the ejection opening of the nozzle 22Kn. In consequence, the counterbalance position of the flexible bag 85 changes within a range between position Ha and position Hc by the expansion and the contraction of the air in the closed system, and thereby, the negative pressure in the closed system can be maintained in an appropriate range, avoiding an adverse effect due to the temperature change during a standby time.

Further, in the flexible bag 85, the pressure is reduced during the pressure reducing process by the fan 68 and thereby, the flexible bag 85 is reset to the counterbalance position Hb as shown in FIG. 18B. Therefore, the pressure holding mechanism 80 can maintain a stable performance with time.

In the present embodiment, the displacement position of the flexible bag 85 corresponding to the volume change due to the expansion and the contraction of the air to be assumed is set within a range from counterbalance position Ha to counterbalance Hc. However, the displacement position may not be necessarily set in this way.

After the counterbalance position of the flexible bag 85 reaches the position Ha, in a case where the expansion of the air continues tentatively, a pressure in the above closed system becomes a positive pressure larger than an atmospheric pressure, so that the meniscus of the ink is formed so as to protrude in a convex shape from the ejection opening to be easily destroyed. In this case, the meniscus is destroyed and therefore, the ink in the head unit 22K possibly leaks from the nozzle 22Kn to an outside, but such state may be assumed as that within an allowance range. The negative pressure in the closed system when the flexible bag 85 is in the counterbalance position Hc may be set to a negative pressure equal to or more than a pressure to the extent of destroying the meniscus of the ink. However, the negative pressure in the closed system increasing with contraction of the air to be assumed should be equal to or less than a negative pressure of destroying the meniscus.

As described above, by changing the volume of the bag-inside space 87 at a standby time, it is also possible to eject the ink from the nozzle 22Kn at the standby time within a range to the extent that an increase of the negative pressure in the above closed system does not create any adverse effect. For example, for preventing a viscosity increase of ink in the nozzle 22Kn during a standby time, the ink which does not contribute to the print of an image is ejected from the nozzle 22Kn into the cap 50 (also called preliminary ejection), thereby making it possible to replace the ink in the nozzle 22Kn for new ink. Further, for printing an image during the standby time, the ink is ejected from the nozzle 22Kn, thereby making it possible to perform an actual printing operation. In addition, during the standby time, it is possible to suck/discharge ink which does not contribute to the print of an image. In any case, it is possible to suck/discharge the ink during the standby time within a range to the extent that an increase of the negative pressure in the above closed system does not create any adverse effect.

(Modification of Pressure Holding Mechanism)

The construction of the pressure holding mechanism 80 is not limited to the aforementioned example, but may have one in which an increase/decrease of the volume in the above closed system can be absorbed to maintain the negative pressure in the closed system. Hereinafter, another construction example of the pressure holding mechanism 80 in the present embodiment will be explained with reference to FIGS. 19 to 22. Portions having functions identical to those in the present embodiment are referred to as identical names and codes, and the explanation thereof is omitted.

Figure 19:
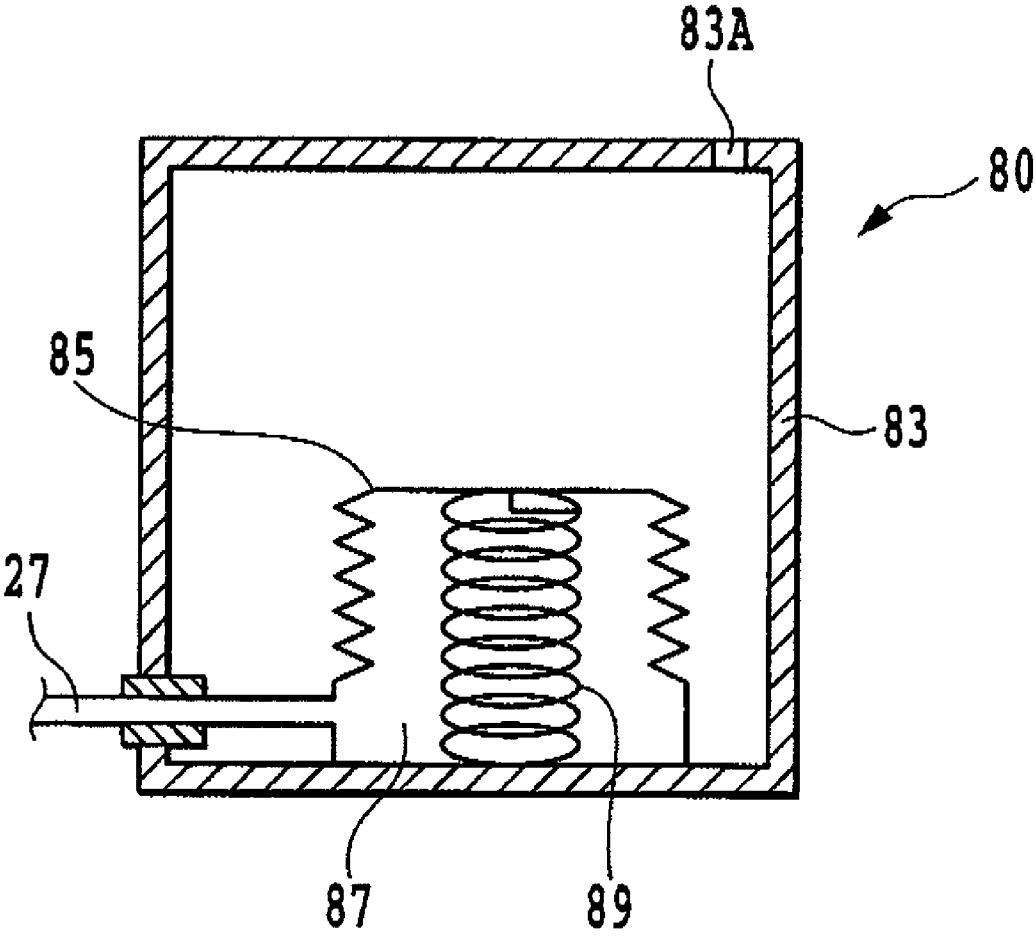
FIG. 19 is a diagram illustrating a modification of a pressure holding mechanism.
Figure 20:
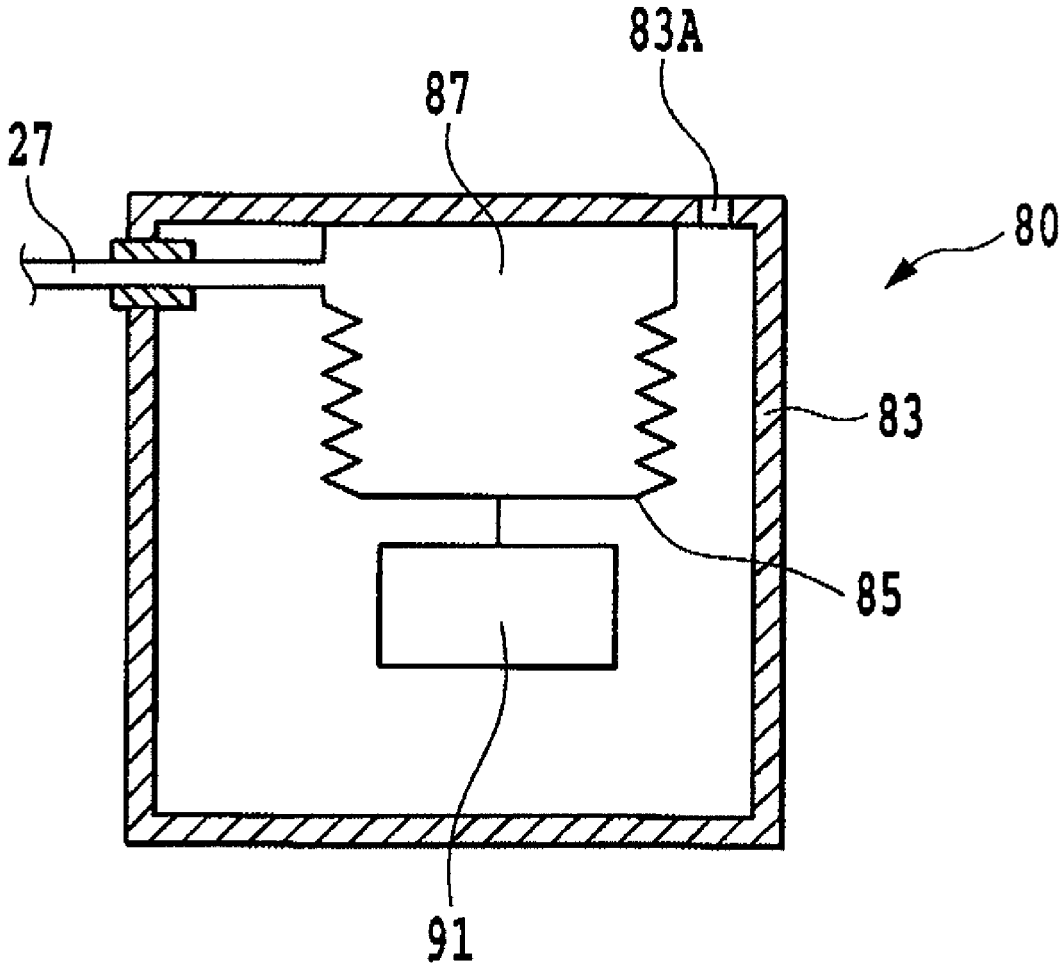
FIG. 20 is a diagram illustrating a modification of a pressure holding mechanism.

A pressure holding mechanism 80 in FIG. 19 is provided with a compression spring 89 located in the flexible bag 85 instead of the tension spring 88 in FIG. 18A as described above. The compression spring 89, as in the case of the tension spring 88, pushes up the inner top surface of the flexible bag 85, thereby applying a negative pressure into the above closed system.

A pressure holding mechanism 80 in FIG. 19 is constructed to push down the inner lower surface of the flexible bag 85 by a weight 91. In a case of the present example, a constant force can be applied to the flexible bag 85 by the weight 91 regardless of an extensible position of the flexible bag 85. Therefore, a corresponding relation between a changing amount in volume and a changing amount in negative pressure in the close system is simplified, thereby easily restricting a change of the negative pressure.

Figure 21:
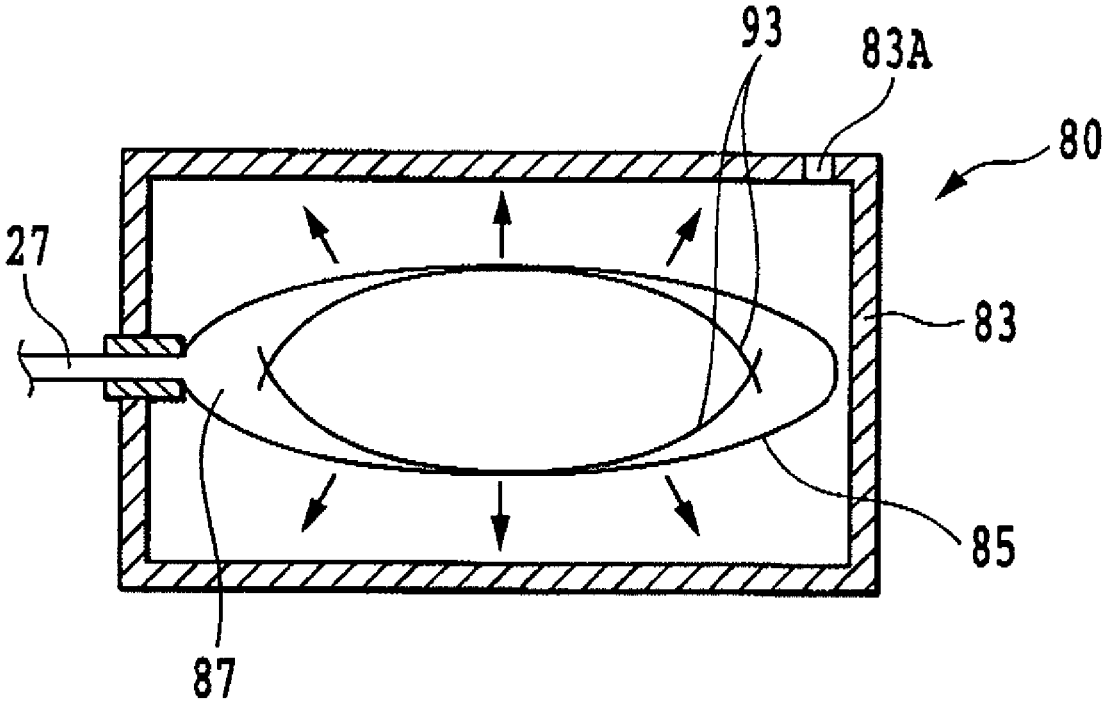
FIG. 21 is a diagram illustrating a modification of a pressure holding mechanism.

A pressure holding mechanism 80 in FIG. 21 is constructed of two sets of arched springs 93 located in the flexible bag 85. The two sets of the arched springs 93 are combined symmetrically in an upward-downward direction for the ends to be connected with each other and urge the inner top surface and the inner lower surface of the flexible bag 85 in an arrow direction in such a manner as to expand the bag-inside space 87. As the bag-inside space 87 expands, the inner top surface and the inner lower surface of the flexible bag 85 and the arched spring 93 largely deform in an arrow direction. The expansion direction of the bag-inside space 87 is not limited to the upward-downward direction, but may be an arbitrary direction.

Figure 22:
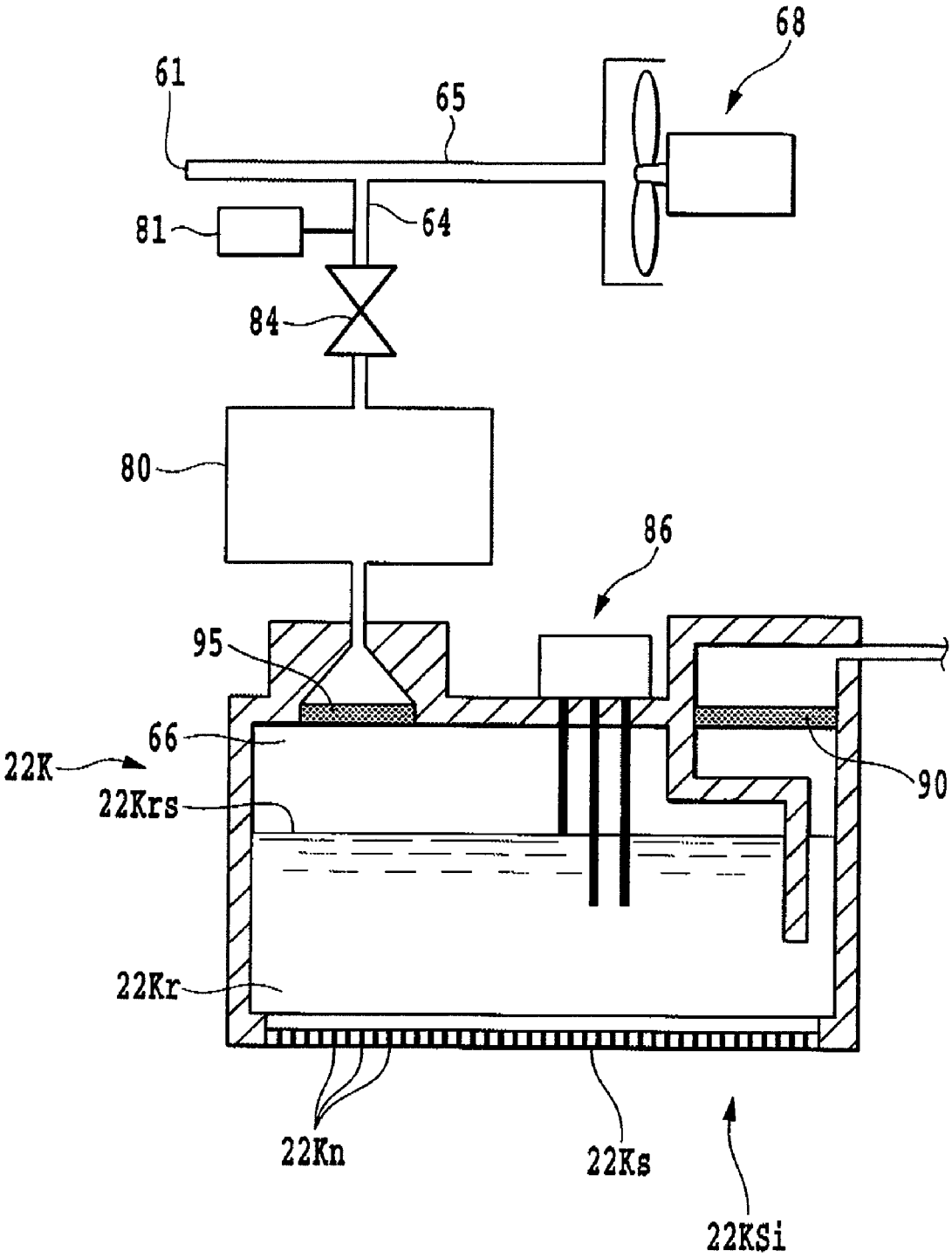
FIG. 22 is a diagram illustrating a modification of a pressure holding mechanism.

A pressure holding mechanism 80 in FIG. 22 is constructed to be integral with a part of the air passage 64. In this way, the pressure holding mechanism 80 may not be required to be independent from the air passage 64 and may be constructed to be integral with another construction member such as the head unit 22K.

As described above, the exemplified pressure holding mechanisms can also obtain the similar effects. The present invention is not limited to, particularly the construction of the pressure holding mechanism and, for example, may combine these exemplified constructions. In other words, the present invention may adopt any construction of being capable of absorbing an increase and a decrease in volume in the above closed system to maintain a negative pressure.

(Fifth Embodiment)

Figure 23:
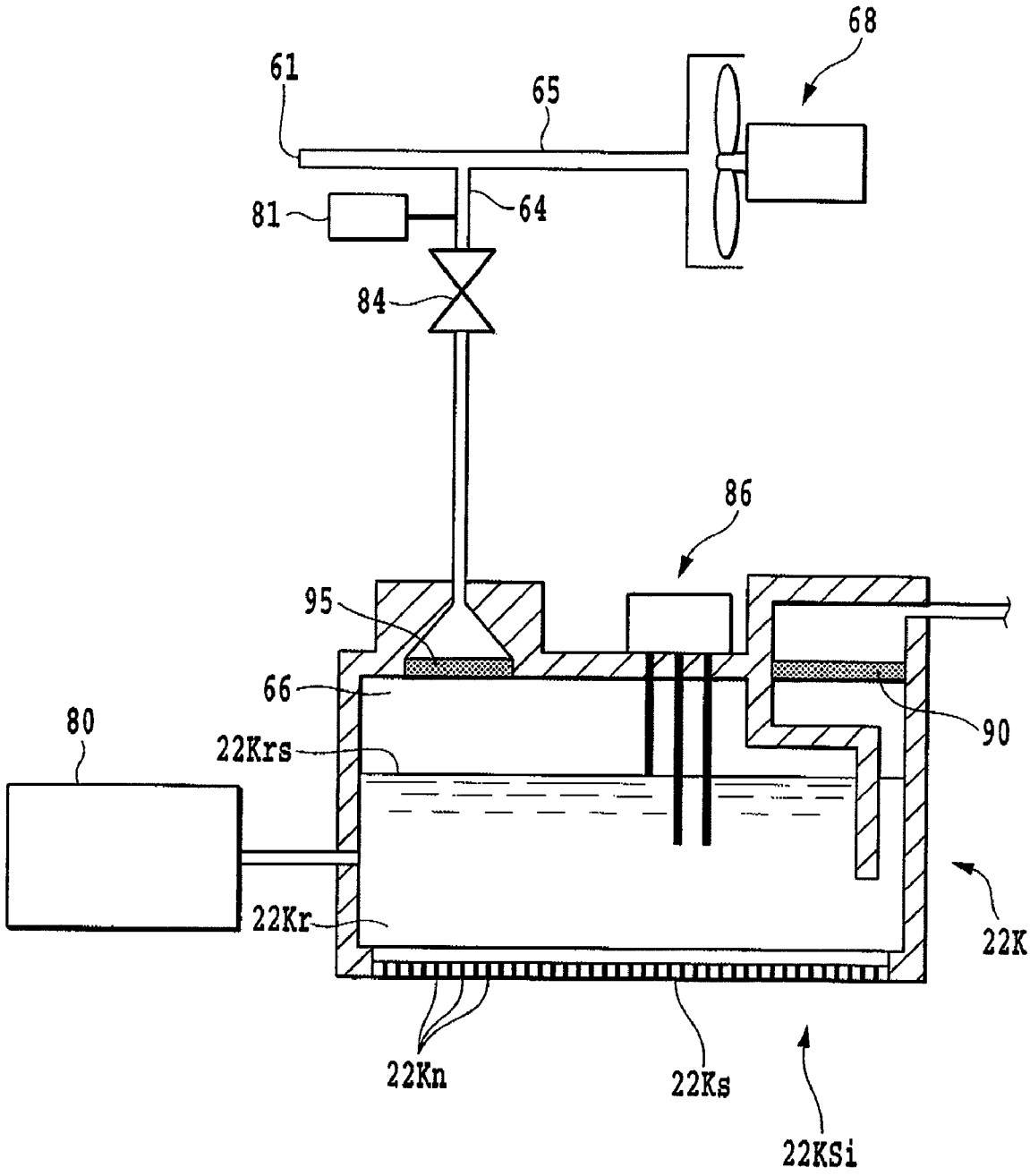
FIG. 23 is a diagram explaining one example connecting a pressure holding mechanism to an ink passage in a fifth embodiment.

A fifth embodiment of the present invention will be explained with reference to the drawing. The pressure holding mechanism 80 may be not necessarily connected to the air passage 64 and may be connected to an ink passage. FIG. 23 is an explanatory diagram in the fifth embodiment showing an example of connecting the pressure holding mechanism 80 to the ink passage, and the pressure holding mechanism 80 is connected to the reservoir 22Kr in the head unit 22K through the pressure holding passage (ink passage) 27. The pressure holding mechanism 80 may adopt the aforementioned various constructions, and ink in the reservoir 22Kr is introduced in the flexible bag 85 provided in the pressure holding mechanism 80. During a standby time of the printing apparatus, expansion and contraction of the air in the closed system including the reservoir 22Kr is absorbed by the pressure holding mechanism 80 through the pressure holding passage (ink passage) 27. In this way, the present embodiment can obtain the pressure holding effect similar to that of the aforementioned embodiment.

The flexible bag 83 of the pressure holding mechanism 80 may be filled with ink or air. In addition, in a case where the ink passage is provided with the pressure holding mechanism as in the case of the present embodiment, the pressure holding mechanism may adopt a unit form independent from the ink passage or may be constructed to be integral with another construction such as the head unit 22K. Further, in the aforementioned embodiment and the present embodiment, by focusing on expansion and contraction of a volume in air, the function of the pressure holding mechanism 80 for absorbing the pressure fluctuation due to the expansion and the contraction is explained. However, strictly speaking, the pressure holding mechanism 80 can also absorb pressure fluctuations due to the expansion and the contraction in volume of ink by a temperature change or an influence of a temperature change to which a construction member such as the head unit 22K is subject.

(Sixth Embodiment)

A sixth embodiment of the present invention will be explained with reference to the drawing. In a case of using a plurality of head units or in a case of forming a plurality of reservoirs in one head unit, the pressure holding mechanism is not necessarily provided in each of the head units or in each of the reservoirs.

Figure 24:
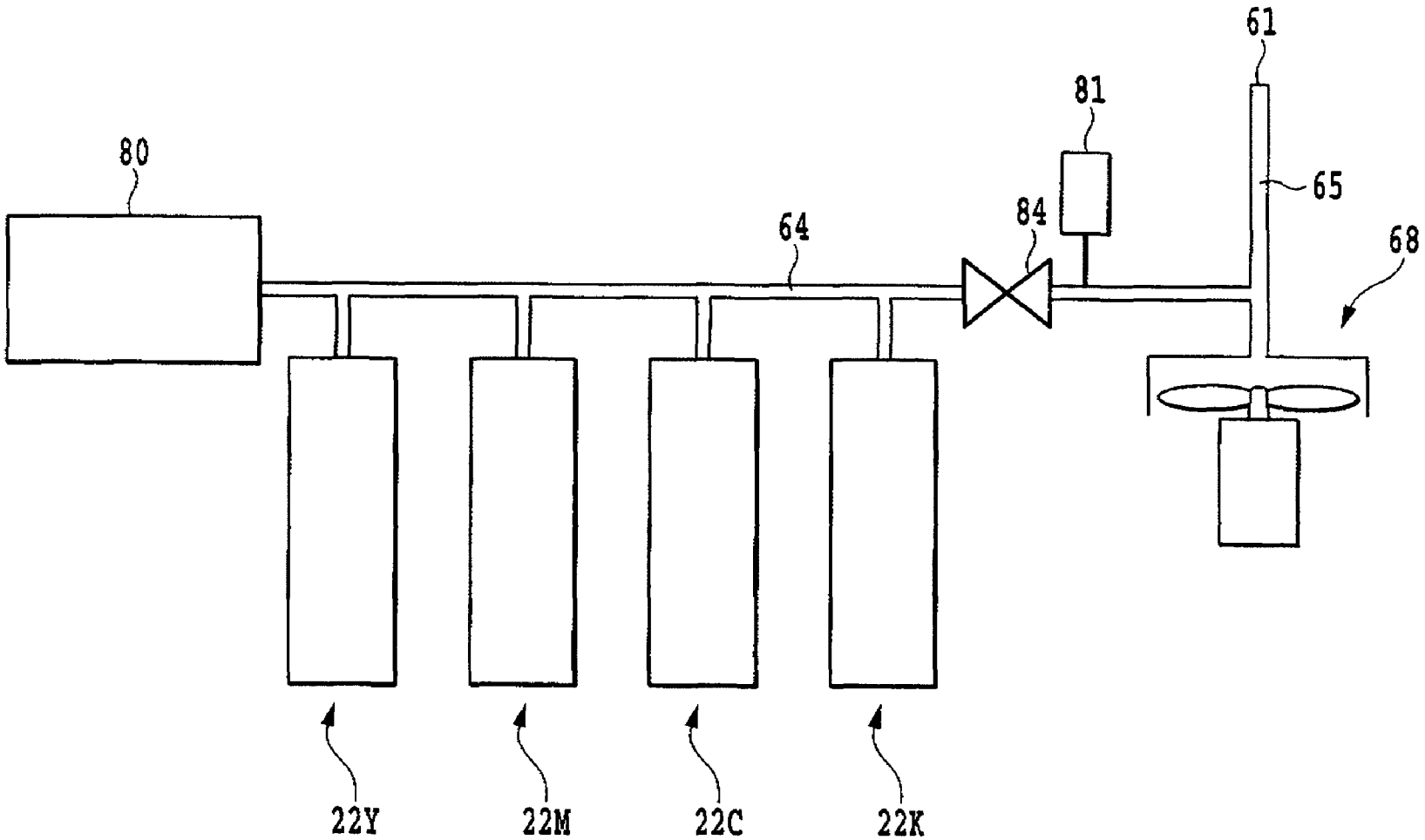
FIG. 24 is a diagram explaining a part in a sixth embodiment.

FIG. 24 is an explanatory diagram showing a part of the sixth embodiment in the present invention and portions identical to those in the aforementioned embodiments are referred to as identical codes and the explanation thereof is omitted. Air passages 64 communicated with the air chambers 66 in the head units 22K, 22C, 22M and 22Y converge into one passage, which is connected to a common, pressure reducing passage 65 via the valve 84. The pressure reducing passage 65 is provided with the fan 68 as described above. In addition, the respective air passages 64 converge into the one passage, which is connected to the common, pressure holding mechanism 80.

As in the case of the aforementioned embodiment, the pressure in the air passage 64 is reduced through the pressure reducing process by the fan 68, thereby making it possible to maintain the pressure in each air chamber 66 of the head units 22K, 22C, 22M and 22Y to be constant. In addition, at a standby time of the printing apparatus after this pressure reducing process, by closing the valve 84, the common, pressure holding mechanism 80 can maintain the negative pressure in each air chamber 66 of the head units 22K, 22C, 22M and 22Y. Since the common, pressure holding mechanism 80 is connected via the air passage 64 where the air exists to the respective head units 22K, 22C, 22M and 22Y, the ink in the respective head units does not mix with each other.

Further, in a case where a range of a negative pressure to be maintained during a standby time of the printing apparatus is different from each other in each of the head units, the pressure holding mechanism 80 may be connected to each of the head units.

(Seventh Embodiment)

Hereinafter, a seventh embodiment of the present invention will be explained with reference to the drawing. The aforementioned embodiment is provided with the construction where the pressure in the head unit is reduced through the pressure reducing process by the fan. However, the method of reducing the pressure in the head unit is not particular to the method of using the fan only.

Figure 25:
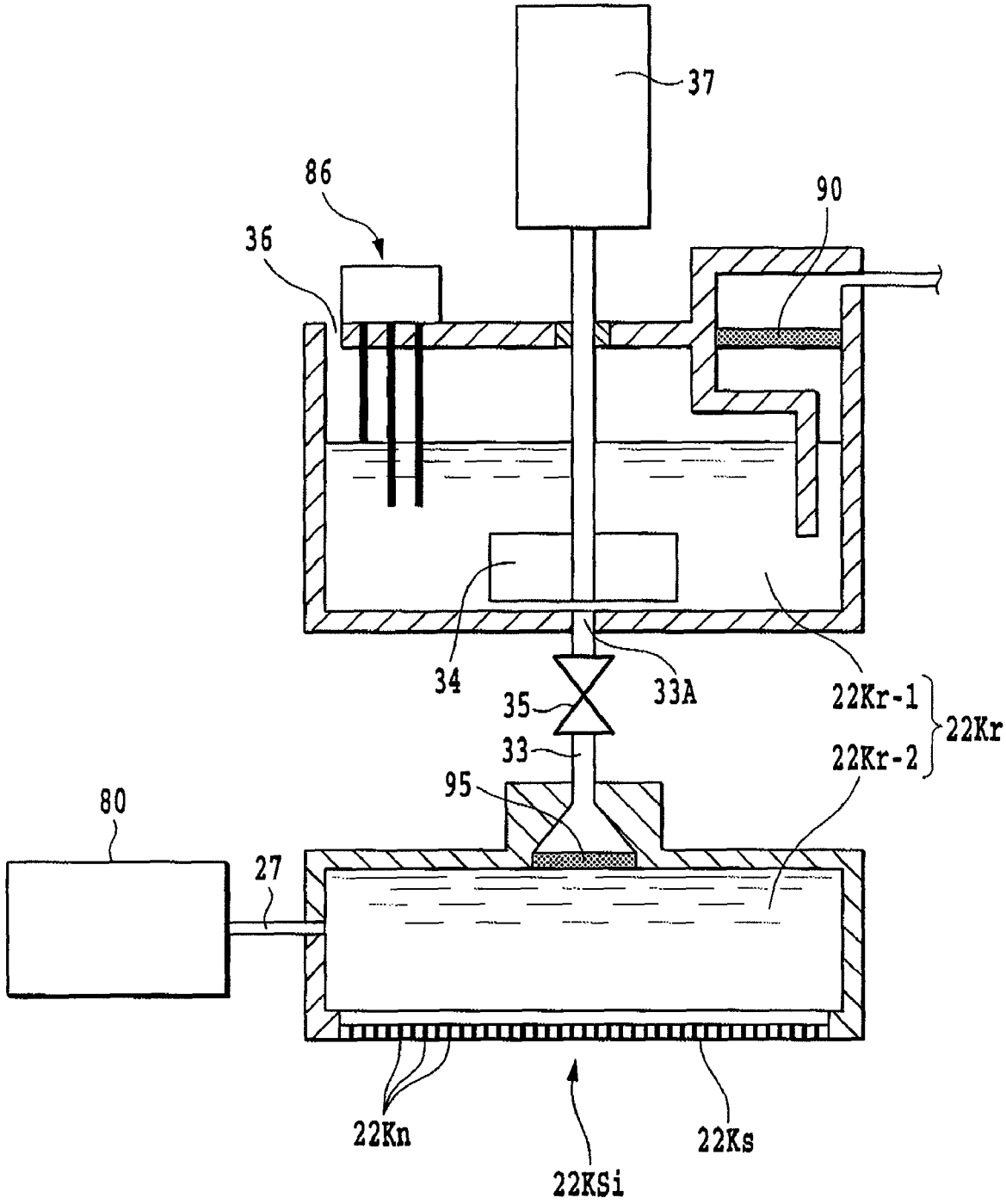
FIG. 25 is a diagram explaining one example adopting a system of reducing a pressure in a head unit in a seventh embodiment.

FIG. 25 is an explanatory diagram showing one example of adopting a method of reducing a pressure in the head unit by a method different from each of the aforementioned embodiments, and portions identical to those in the aforementioned embodiment are referred to as identical codes and the explanation thereof is omitted.

A reservoir 22Kr in the head unit 22K of the present embodiment is divided into a first reservoir 22Kr-1 and a second reservoir 22Kr-2 which are respectively positioned upward and downward, and the lower-side second reservoir 22Kr-2 is integral with an ejection portion 22KSi. The reservoirs 22Kr-1 and 22Kr-2 ate communicated with each other by a communicating passage 33 and the communicating passage 33 is provided with a valve 35. The upper-side first reservoir 22Kr-1, in a case of using an ink tank 28 as a main tank, may serve as a sub-tank. In the aforementioned embodiment, the ejection portion 22KSi and the reservoir 22Kr are constructed to be integral with each other.

The first reservoir 22Kr-1 is communicated through an air communicating opening 36 with an atmosphere. In addition, a pump 34 positioned in the vicinity of a suction opening 33A communicating with the communicating passage 33 is provided in the first reservoir 22Kr-1 and the pump 34 is driven by a motor 37 and serves as a centrifugal fan. The second reservoir 22Kr-2 is connected through the pressure holding passage (ink passage) 27 to the pressure holding mechanism 80. By closing the valve 35, the ejection portion 22KSi forms a closed system similar to that of the aforementioned embodiment.

In a case of the present embodiment, the pump 34 in the ink in the first reservoir 22Kr-1 is rotated by the motor 37 and a pressure in the vicinity of the suction opening 33A is reduced by a centrifugal force of the ink generated by the rotation. The reduced pressure can apply a negative pressure to the ink in the ejection portion 22KSi as in the case of the aforementioned embodiment. By closing the valve 35 at a standby time after executing the pressure reducing process by the pump 34 in this way, the ejection portion 22KSi forms a closed system as in the case of the aforementioned embodiment and the negative pressure in the closed system is maintained by the pressure holding mechanism 80 as in the case of the aforementioned embodiment.

The present embodiment has no space (air chamber 66) for positively storing the air in the above closed system. However, since it is considered that air bubbles are mixed into the closed system as a result of the printing operation, it is possible to activate the pressure holding mechanism 80 in such a manner as to absorb the expansion and the contraction of the air bubble as in the case of the aforementioned embodiment. The valve 35 may be provided in the air communicating opening 36 of the first reservoir 22Kr-1 constituting the sub-tank. In this case, by closing the air communicating opening 36 by the valve 35 at a standby time, an air layer in the first reservoir 22Kr-1 is contained in the above closed system. Therefore, the pressure holding mechanism 80 can be activated as in the case of each of the first and third embodiments. In this case, it is required to provide a sealing mechanism for blocking the inside of the first reservoir 22Kr-1 from an outside at a portion in which a shaft (connection portion) connecting the pump 34 and the motor 37 passes through the first reservoir 22Kr-1. In addition, the first and second reservoirs 22Kr-1 and 22Kr-2, and the like may be united to form a printing head or the first reservoir 22Kr-1 may be provided in the side of the printing apparatus and the second reservoir 22Kr-2 may be provided in the side of the printing head.

(Other Embodiment)

An example of the ejection system of ink may include a system using an electro thermal conversion element as an ejection energy generating element as in the case of the aforementioned embodiment and further, various systems using a piezoelectric element or the like. That is, the present invention can be widely applied to printing heads having various ejection systems. The printing head to which the present invention can be applied is not limited only to an inkjet printing head capable of ejecting ink and can be applied to a printing head capable of printing an image by various systems.

The printing system for printing an image on a print medium using ink is not limited to a so-called full line system such as the aforementioned embodiment, that is, is not limited only to a printing system using an elongated printing head extending over an entire printing region in the width direction of a print medium. For example, the printing system may be of a so-called serial scanning system for printing an image with travel of the printing head in a main scanning direction and a carrying operation of a printing medium in a sub scanning direction. Various types of fans are used as the fan 68 in the first to the third embodiments. A pump of a non-displacement type such as a propeller type or a pump of a displacement type may be used. Further, the present invention can be widely applied to a liquid supplying apparatus for supplying a liquid other than ink (chemical and the like), a liquid ejection head for ejecting a liquid other than ink and a liquid ejection apparatus using the liquid ejection head.

The present invention comprises an inkjet printing head which is capable of ejecting ink in a liquid chamber from a nozzle, the liquid chamber being capable of introducing a negative pressure. This inkjet printing head may be provided with a pressure holding mechanism capable of a volume change of fluid in the liquid chamber in such a manner as to hold the negative pressure in the liquid chamber when the liquid chamber forms a closed system which blocks off from an atmosphere other than the nozzle. In this case, the pressure holding mechanism may include a closed space which is communicated with the liquid chamber and a volume of which can increase/decrease and a load applying portion applying a load in a direction of increasing the closed space to a forming member forming the closed space. The forming member may include at least a flexible member and also may form the closed space by combining a rigid cylinder with a rigid piston. Further, the load applying portion may include the aforementioned spring member or weight and also may adopt various members. In other words, the load applying portion may adopt any member capable of applying a load in a direction of increasing the closed space.

The liquid chamber may include an ink reservoir communicated with the nozzle, an air chamber communicated with the ink reservoir, a negative pressure introducing portion capable of introducing the negative pressure into the air chamber from a negative pressure generating portion, and an ink introducing portion capable of introducing the ink into the ink reservoir from an ink supplying portion. In this case, the liquid chamber is designed to form a closed system by blocking off the negative pressure generating portion from the negative pressure introducing portion and also blocking off the ink supplying portion from the ink introducing portion.

The negative pressure generating portion may include an air passage for releasing the air in the air chamber to an outside in such a manner as to reducing a pressure in the liquid chamber, and further, by communicating the air chamber with a pressure holding passage in which flow of the air is generated by a fan, the air in the air chamber can be sucked into the pressure holding passage. The negative pressure generating portion may be provided with an ink reservoir which is communicated via a communicating passage with the liquid chamber to be capable of reserving the ink, and a pump for sucking the ink in the communicating chamber from the liquid chamber toward the ink reservoir in such a manner as to apply the negative pressure to the ink in the liquid chamber.

It should be noted that in the present specification, "print" (also called image formation) is not limited to the matter for forming intentional information such as characters and graphics. That is, "print" includes cases of widely forming an image, a design, a pattern and the like on a print medium or processing a medium whether or not the information is intentional or whether or not the information is elicited so that a person can visually perceive it.

"Print medium" (also called seat) may include not only a paper used in a general printing apparatus, but also elements capable of receiving ink, such as clothes, plastic films, metal plates, ceramics, woods, and leathers.

Further, "ink" should be broadly interpreted in the same way as the definition of "print". That is, "ink" may include a liquid supplied for formation of an image, a design, a pattern and the like by applying the ink on a print medium, processing of a print medium, or treatment of ink (for example, solidification or encapsulation of a coloring material in the ink applied to the print medium). A liquid other than the ink may be used in the apparatus of the present invention without mentioning.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-327997, filed Dec. 19, 2007 and 2007-327996, filed Dec. 19, 2007 which is hereby incorporated by reference herein in its entirety.

What is claimed is:

1. An inkjet printing apparatus including a printing head having an ejection portion configured to eject ink and an ink supplying apparatus configured to supply the ink to the printing head, the ink supplying apparatus comprising:

a liquid chamber which reserves ink supplied to the ejection portion;

an air releasing portion which releases air in a space provided at an upper side of the liquid chamber to an outside;

an air introducing portion which introduces air of the outside into the space; and a control portion which controls a negative pressure in the space by adjusting an air releasing amount from the air releasing portion, wherein the air releasing portion releases air in the space and air from the air introducing portion via an air passage to the outside by a fan, and wherein the air passage includes a portion having a first passage which communicates with the space, a second passage which communicates with the air releasing portion, and a third passage which communicates with the air introducing portion, and wherein in the portion all of the first, second and third passages are connected, wherein the supplying apparatus further comprises:

a pressure detecting sensor provided in the first passage; and a valve provided between the space and the first passage, the valve being operable to block and release the first passage from the space, wherein before ejection of ink from the ejection portion, and in a state where the valve blocks the first passage, the control portion drives the fan and thereafter releases the first passage by the valve, responsive to a detection by the pressure detecting sensor of a predetermined pressure in the first passage.

2. The inkjet printing apparatus according to claim 1, wherein the control portion is controlled based upon a detection result of the pressure detecting sensor to maintain the pressure in the space to be in a constant negative pressure.

3. The inkjet printing apparatus according to claim 1, wherein either the first passage and the second passage or the second passage and the third passage are arranged in a straight line.

4. The inkjet printing apparatus according to claim 1, further comprising a pressure holding device for holding to apply a negative pressure into the liquid chamber in a state where the ink introducing portion, the air introducing portion and the air releasing portion are blocked from the liquid chamber.

5. The inkjet printing apparatus according to claim 4, wherein the pressure holding device includes a closed space which is communicated with the liquid chamber and which has a volume which can increase/decrease, and a load applying portion for applying a load in a direction of increasing the volume of the closed space to a forming member for forming the closed space.

6. The inkjet printing apparatus according to claim 5, wherein the forming member includes at least a flexible member.

7. An inkjet printing apparatus including a printing head having an ejection portion configured to eject ink and an ink supplying apparatus configured to supply the ink to the printing head, the ink supplying apparatus comprising:

a liquid chamber which reserves ink supplied to the ejection portion, an air releasing member which releases air in a space provided at the liquid chamber to an outside;

a control portion which controls a negative pressure in the space by adjusting an air releasing amount from the air releasing member, wherein the air releasing member releases air in the space via an air passage to the outside, and wherein the supplying apparatus further comprises:

a pressure detecting sensor provided in the air passage; and a valve provided between the space and the pressure detecting sensor, the valve being operable to block and release the air passage from the space, wherein before ejection of ink from the ejection portion, and in a state where the valve blocks the air passage, the control portion drives the air releasing member and thereafter releases the air passage by the valve, responsive to a detection by the pressure detecting sensor of a predetermined pressure in the air passage.

8. An inkjet printing apparatus including a printing head having an ejection portion configured to eject ink and an ink supplying apparatus configured to supply the ink to the printing head, the ink supplying apparatus comprising:

a liquid chamber which reserves ink supplied to the ejection portion, an air releasing member which releases air in a space provided at the liquid chamber to an outside;

a control portion which controls a negative pressure in the space by adjusting an air releasing amount by the air releasing member, wherein the air releasing member releases air in the space via an air passage to the outside, and wherein the supplying apparatus further comprises:

a valve provided between the space and the air passage, the valve being operable to block and release the air passage from the space, wherein before ejection of ink from the ejection portion, and in a state where the valve blocks the air passage, the control portion drives the air releasing member and thereafter releases the air passage by the valve.

* * * * *